US007828569B2

(12) United States Patent
Aronson et al.

(10) Patent No.: US 7,828,569 B2
(45) Date of Patent: Nov. 9, 2010

(54) RECEPTACLE WITH MULTIPLE CONTACT SETS FOR DIFFERENT CONNECTOR TYPES

(75) Inventors: Lewis B. Aronson, Los Altos, CA (US); Donald A. Ice, Milpitas, CA (US)

(73) Assignee: Finisar Corporation, Sunnyvale, CA (US)

( * ) Notice: Subject to any disclaimer, the term of this patent is extended or adjusted under 35 U.S.C. 154(b) by 95 days.

(21) Appl. No.: 12/211,734

(22) Filed: Sep. 16, 2008

(65) Prior Publication Data

US 2009/0111331 A1 Apr. 30, 2009

Related U.S. Application Data

(60) Provisional application No. 60/973,102, filed on Sep. 17, 2007.

(51) Int. Cl.
*H01R 27/00* (2006.01)

(52) U.S. Cl. ..... 439/218

(58) Field of Classification Search ..... 439/218, 439/188, 489, 676
See application file for complete search history.

(56) References Cited

U.S. PATENT DOCUMENTS

| | | | | |
|---|---|---|---|---|
| 5,118,312 | A * | 6/1992 | Lu | 439/676 |
| 5,244,402 | A * | 9/1993 | Pasterchick et al. | 439/217 |
| 5,501,608 | A * | 3/1996 | Scheer et al. | 439/218 |
| 5,909,596 | A * | 6/1999 | Mizuta | 710/63 |
| 5,928,020 | A * | 7/1999 | Bishop et al. | 439/188 |
| 6,126,465 | A * | 10/2000 | Franks, Jr. | 439/218 |
| 6,765,485 | B2 * | 7/2004 | Lee et al. | 340/531 |
| 6,890,197 | B2 * | 5/2005 | Liebenow | 439/188 |
| 7,241,158 | B2 * | 7/2007 | Takagi | 439/188 |
| 7,314,392 | B2 * | 1/2008 | Pharn et al. | 439/676 |

FOREIGN PATENT DOCUMENTS

| | | |
|---|---|---|
| JP | 2003-059580 | 2/2003 |
| JP | 2003-331996 | 11/2003 |
| JP | 2004-272704 | 9/2004 |
| KR | 10-2003-0091076 | 12/2003 |
| KR | 10-04441311 | 8/2004 |

* cited by examiner

*Primary Examiner*—Neil Abrams
(74) *Attorney, Agent, or Firm*—Workman Nydegger

(57) ABSTRACT

A receptacle that is configured to receive connectors of different types. If a connector of one type is received into the receptacle, the connector contacts engage one set of receptacle contacts. If a connector of another type is received into the receptacle, the connector contacts engage another set of receptacle contacts, and so forth for potentially other connector types and other contact sets. A communication system may also control which PHY circuitry communicates with the receptacle depending on which connector type is plugged into the receptacle. The receptacle can include a connector detection mechanism configured to detect whether a connector of the first type or second type is inserted into the receptacle. Circuitry and pin design of the receptacle also depends on the first and second connector types.

18 Claims, 31 Drawing Sheets

300D

300E

RECEPTACLE WITH MULTIPLE CONTACT SETS FOR DIFFERENT CONNECTOR TYPES

CROSS-REFERENCE TO RELATED APPLICATIONS

This patent application claims the benefit of U.S. provisional patent application Ser. No. 60/973,102, filed Sep. 17, 2007, which provisional patent application is incorporated herein by reference in its entirety.

BACKGROUND

When a connector is plugged into a receptacle, each contact of the connector makes electrical contact with corresponding contacts in the receptacle. This allows electrical signals to pass between the connector and receptacle. Typically, the receptacle uses the same set of contacts each time the connector is plugged in, though in many systems only a subset of the contacts in the set may be used by a given plug or receptacle of a system. Thus, in order for a connector to work with the receptacle, the connector should be designed such that the set of contacts on the connector make contact with the set of contacts on the receptacle. If a connector of a type that has differently configured contact sets is to be plugged into the receptacle, either the connector will not fit into the receptacle, or even if the connector were to fit, the connector contact set would not properly interface with the receptacle contact set. Thus, receptacles have strict limits as to the types of connectors that the receptacle may receive.

BRIEF SUMMARY

Embodiments described herein relate to a receptacle that is configured to receive connectors of different types. If a connector of one type is received into the receptacle, the connector contacts engage one set of receptacle contacts. If a connector of another type is received into the receptacle, the connector contacts engage another set of receptacle contacts, and so forth for potentially other connector types and other contact sets. Such a receptacle will also be referred to herein as a "plural use" receptacle. When such a plural use receptacle is configured for use with just two different connector types, each associate with it own receptacle contact set, the receptacle may be referred to more specifically as a "dual use" receptacle. A connector detection mechanism associated with the receptacle may detect which type of connector is inserted into receptacle, and route electrical signals to and from the appropriate receptacle contacts as appropriate given the connector type. This allows a second connector to work with a set of contacts with a different mechanical layout. For instance, one contact sets may be for use at high electrical frequencies, where considerations such as the electrical impedance and crosstalk become paramount.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Embodiments described herein related to a receptacle that may be used to receive connectors of different types. If a connector of one type is received into the receptacle, one set of receptacle contacts is used to make electrical contact with the connector. If a connector of another type is received into the receptacle, another set of receptacle contacts is used to make electrical contact with the connector, and so forth.

A particular embodiment of a plural use receptacle set for multiple connectors is described hereinafter with respect to FIGS. 1A through 9. However, it will be apparent to one of ordinary skill in the art, after having reviewed this description, that the principles of the present invention extend to any receptacle that has multiple (two or more) sets of contacts, in which each set of contacts is used for coupling with a different connector type. For instance, the dual use receptacle of FIGS. 1A through 9 is described as being adapted to receive two different types of connectors. However, the principles described herein may extend to other plural use receptacles adapted to receive three or more different connector types. Furthermore, the receptacle of FIGS. 1A through 9 is described as being suited towards receiving two different types of connectors, 1) a LASERWIRE 10 Gb/s active cable connector, and 2) an RJ-45 connector as defined in the standard TIA-968-A. However, the principles described herein are not limited to a receptacle that is capable of receiving a particular connector type.

As a second preliminary matter, while an RJ-45 connector is well known as it is, the other type of connector (referred to herein as a LASERWIRE connector) is not known to the general public. Thus, the LASERWIRE connector is described in great detail in the description that follows FIGS. 10A through 22D.

Figure 1A:
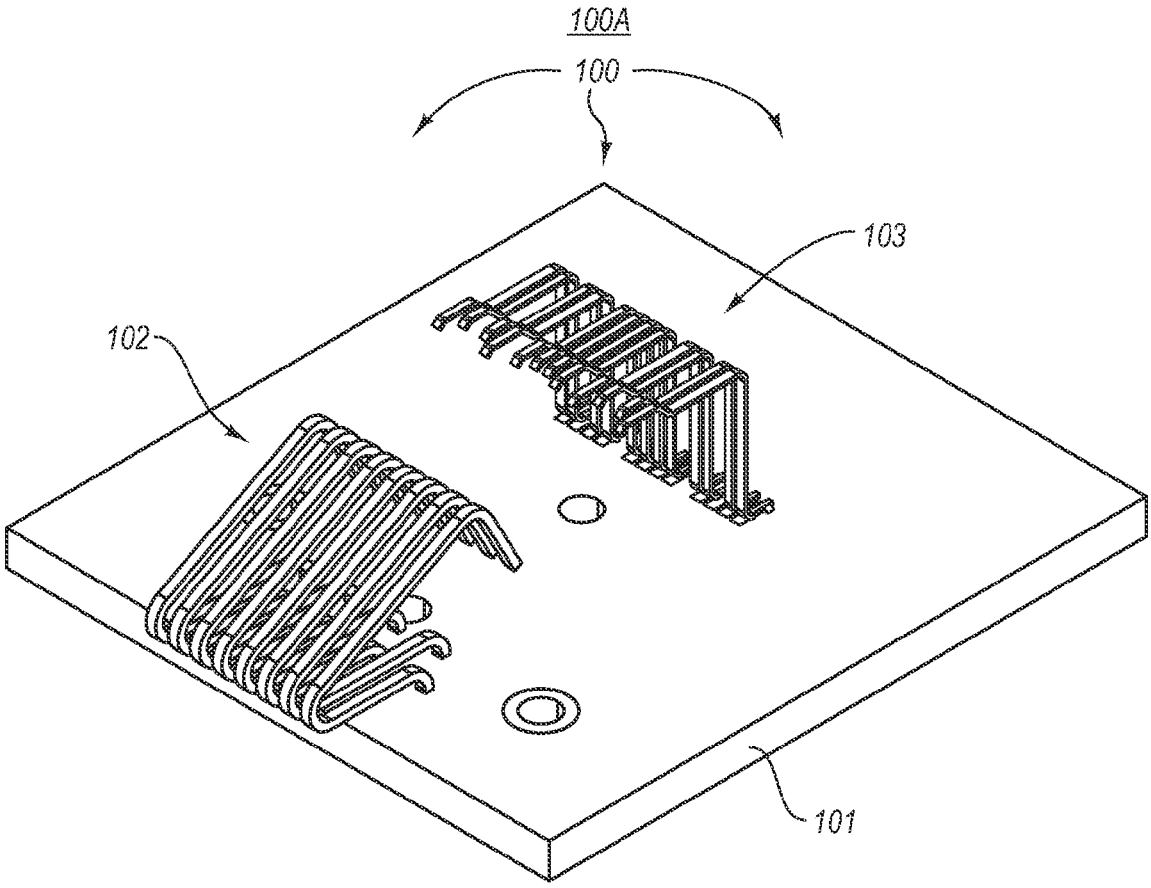
FIG. 1A illustrates metal contact components of a receptacle from a top-front perspective.
Figure 1B:
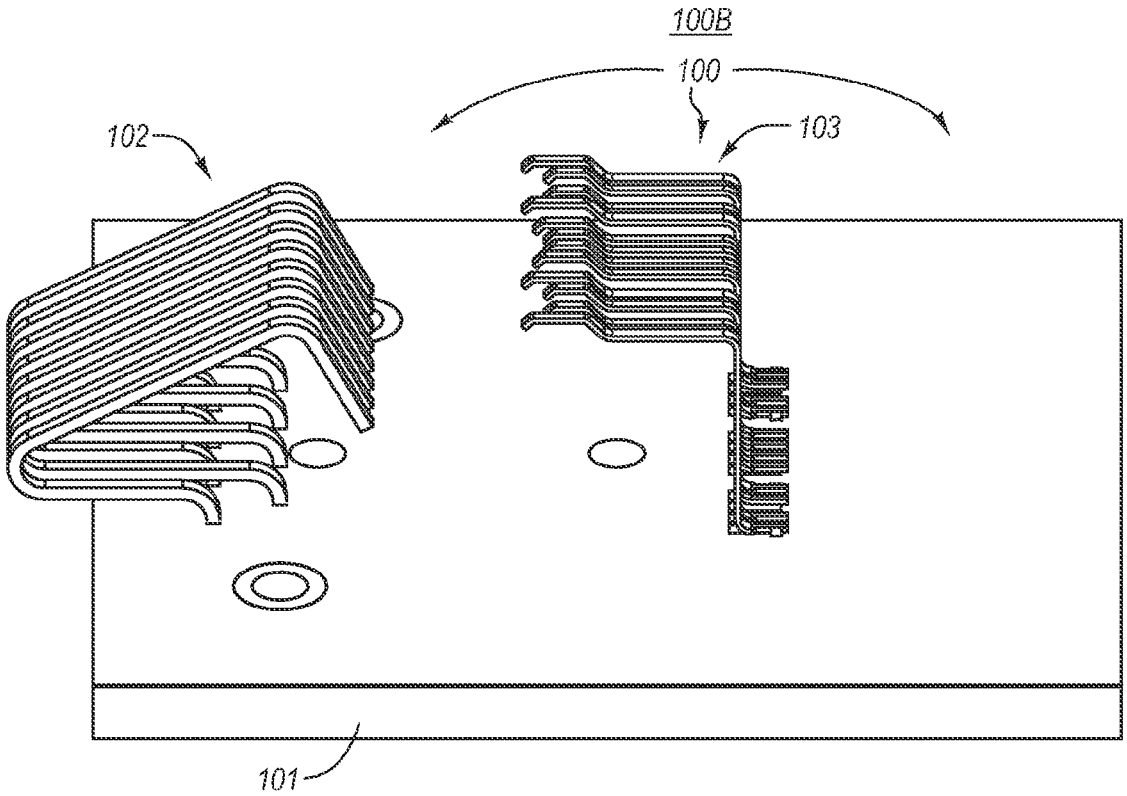
FIG. 1B illustrates the metal contact components of the receptacle of FIG. 1A from a top-side perspective.
Figure 1C:
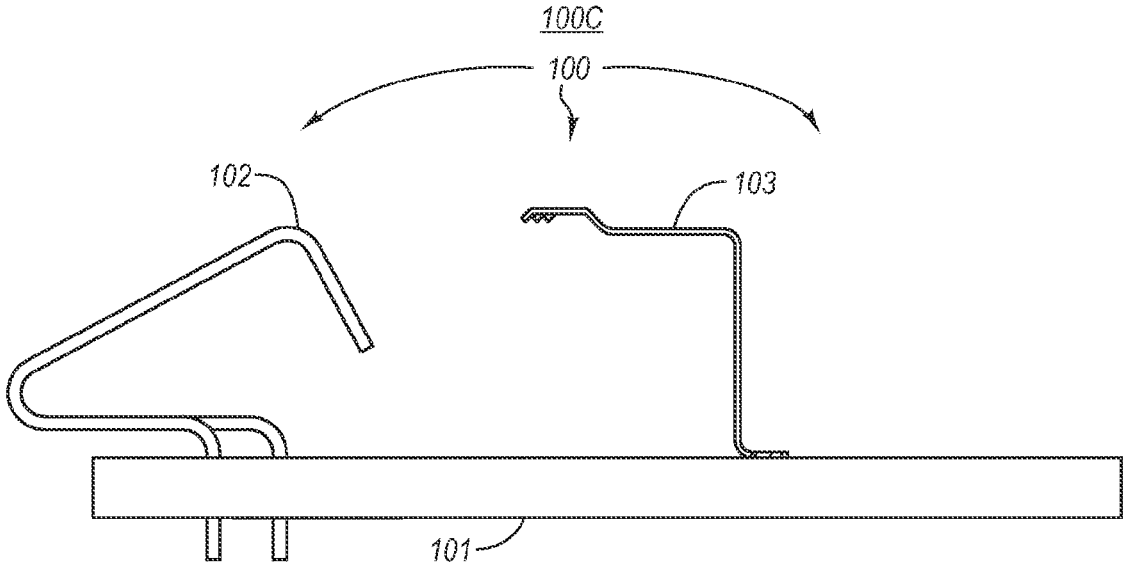
FIG. 1C illustrates the metal contact components of the receptacles of FIGS. 1A and 1B from a side view.

An example plural use receptacle will now be described with respect to FIGS. 1A through 9. FIG. 1A illustrates components 100 of the receptacle from a top-front perspective 100A. FIGS. 1B and 1C illustrate a respective top perspective view 100B and side view 100C of the components 100 of the receptacle. In this description, "front side" with respect to a receptacle means the side of the receptacle closer to where the connector is inserted, while "rear side" means the side of the connector deeper into the receptacle. "Top side" means the side of the connector that engages with the latch of the connector, whereas "bottom side" means the side of the connector opposite the latch. This terminology will be consistent throughout this description, except for the description of FIGS. 10A through 22D, where the front side and back side are reversed in order to more intuitively describe the LASERWIRE connector.

Of course, the components 100 are only a small portion of the total components of the receptacle. For now, only a printed circuit board 101 having contact sets 102 and 103 mounted thereon are shown. The contact set 102 is to engage an RJ-45 connector and includes 8 contacts total. While the contact set 102 is affixed to the printed circuit board 101 at one end, the contact set 102 is not bound at the other end, allowing for the contacts of the contact set 102 to flex downward somewhat when an RJ-45 connector is plugged into the receptacle. This is the same manner in which a conventional RJ-45 connector receptacle engages the plug contacts. The contact set 103 is for engaging a LASERWIRE connector as described with respect to FIGS. 10A through 22D. Each of the contact sets 102 and 103 is electrically coupled to traces in the printed circuit board 101. Such traces are not illustrated in FIGS. 1A through 1C, though they are illustrated abstractly in FIG. 9, and described further with respect to FIG. 9.

Figure 2A:
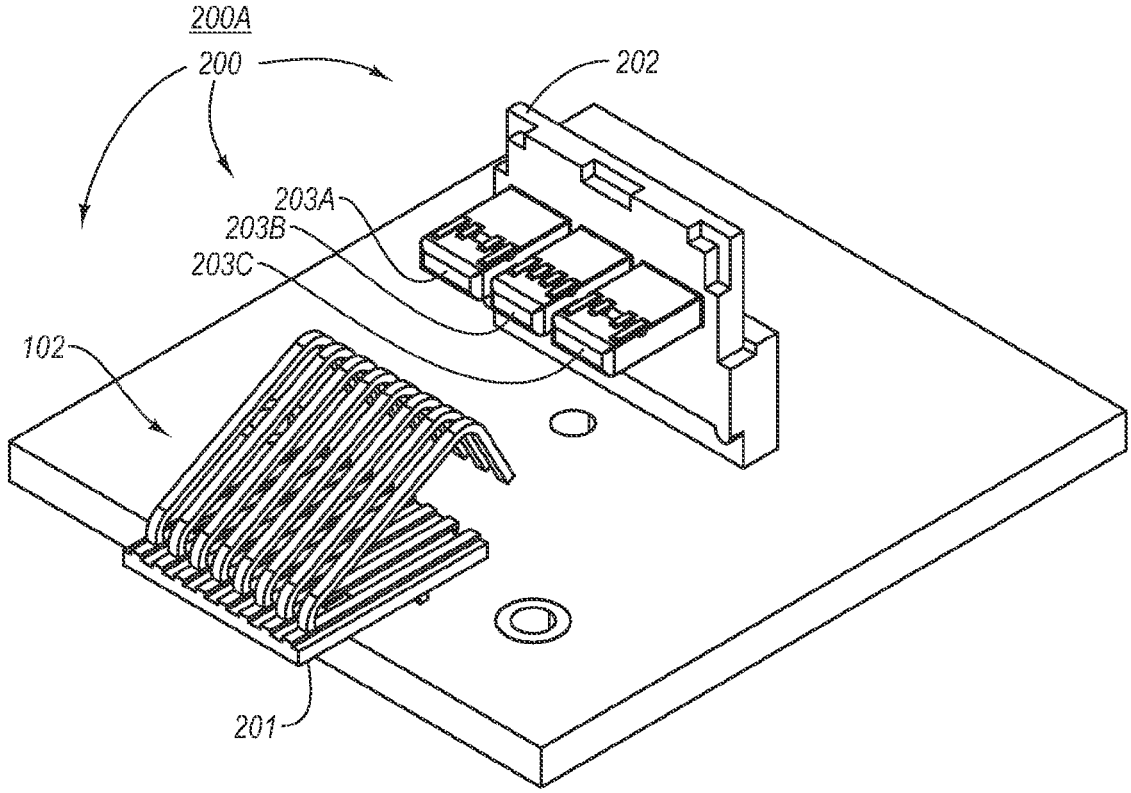
FIG. 2A illustrates a top front perspective view of components of the receptacle which supplements the components of FIGS. 1A through 1C by adding an RJ-45 contact alignment retainer and a LASERWIRE™ contact body.
Figure 2B:
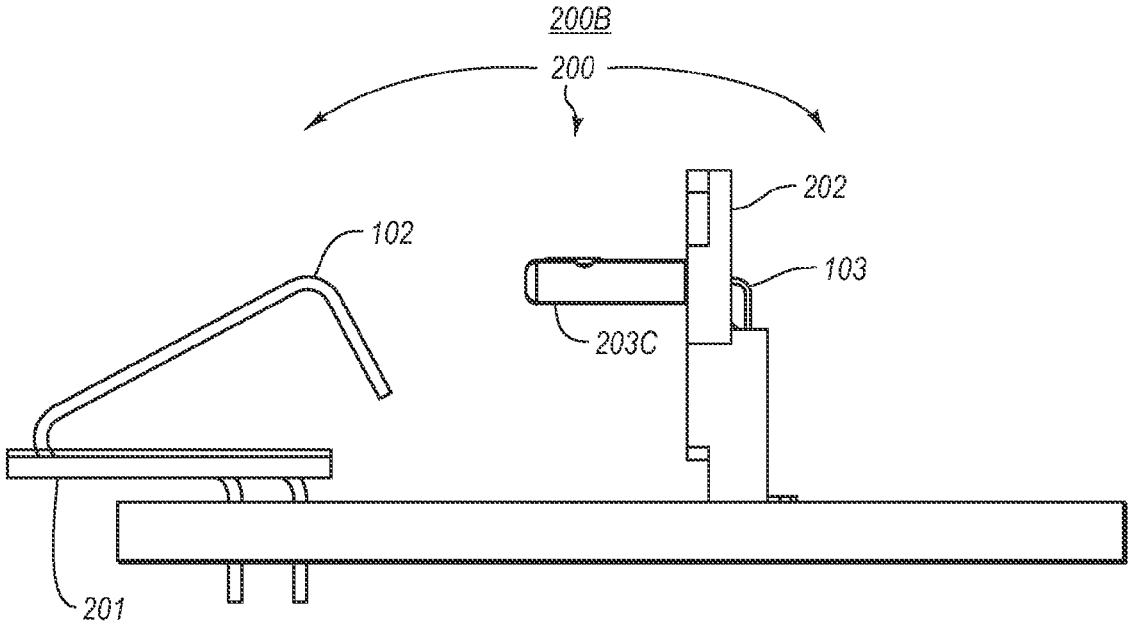
FIG. 2B illustrates a side view of components of the receptacle of FIG. 2A.
Figure 2C:
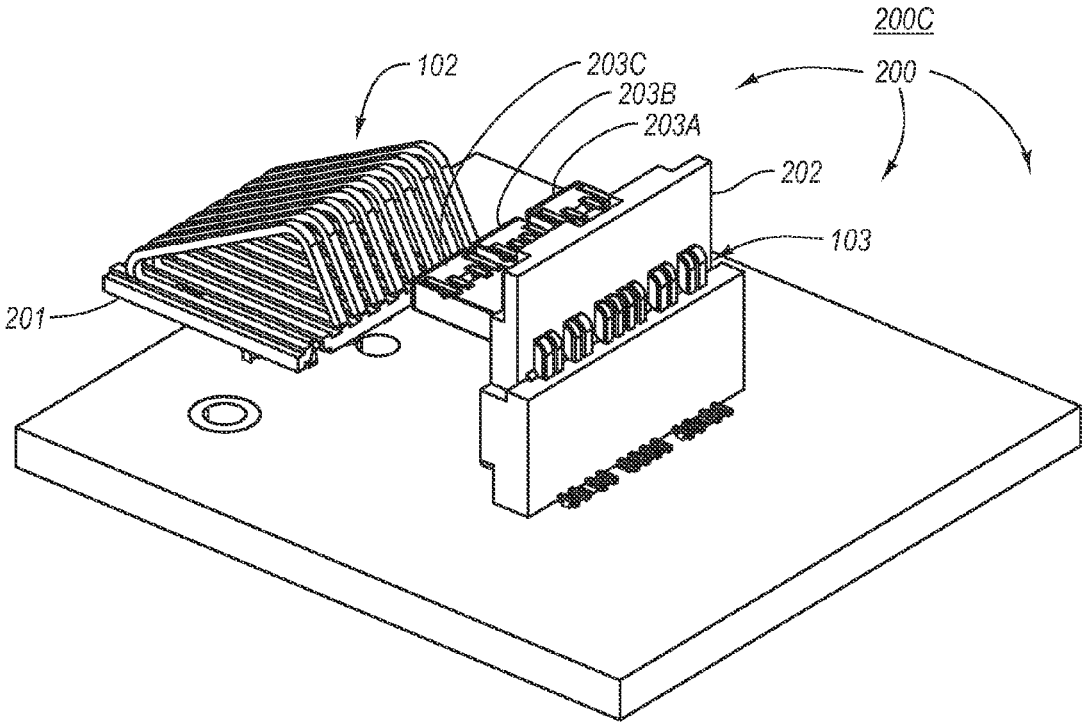
FIG. 2C illustrates a top back perspective view of components of the receptacle of FIGS. 2A and 2B.

FIGS. 2A through 2C illustrate a respective top front perspective view 200A, side view 200B, and top back perspective view 200C of components 200 of the receptacle. The components 200 of FIGS. 2A through 2C add to the components 100 of FIGS. 1A through 1C, except that an RJ-45 contact alignment retainer 201 and LASERWIRE contact body 202 are also shown.

Figure 3A:
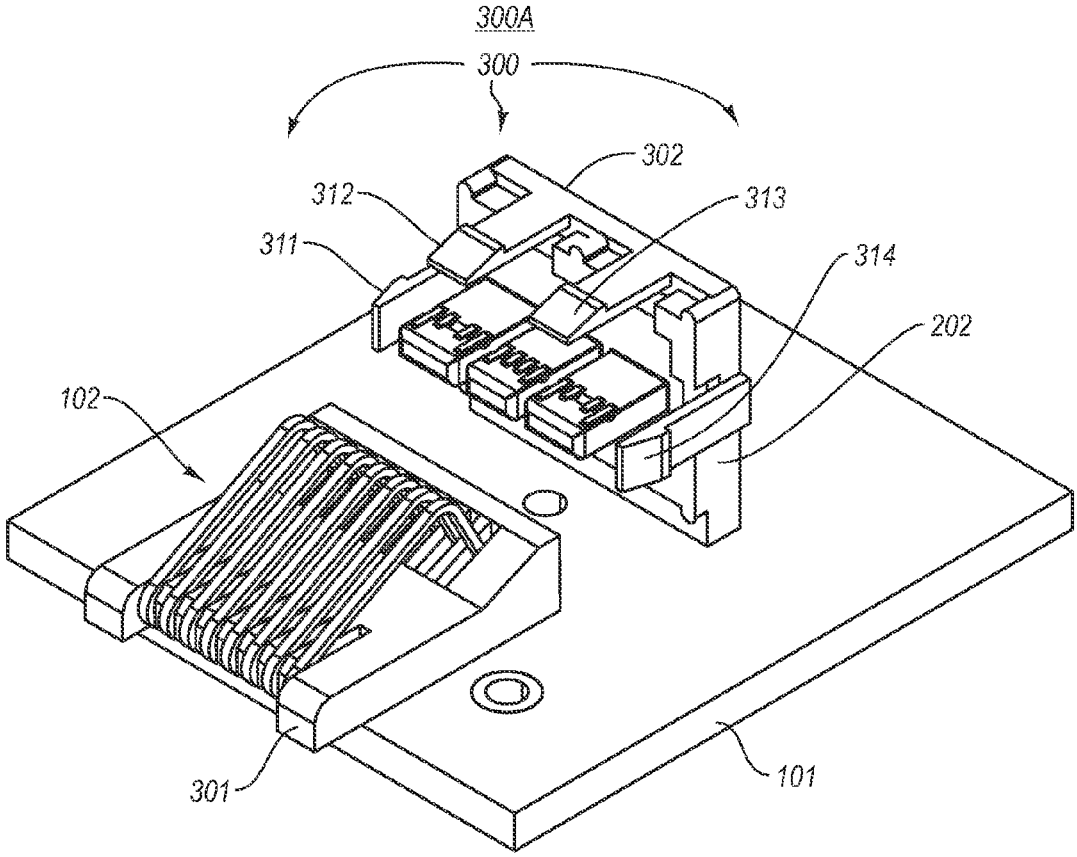
FIG. 3A illustrates a top front perspective view of components of the receptacle which supplements the components of FIGS. 2A through 2C by adding an RJ-45 contact base and a LASERWIRE™ top cover/housing anchor.
Figure 3B:
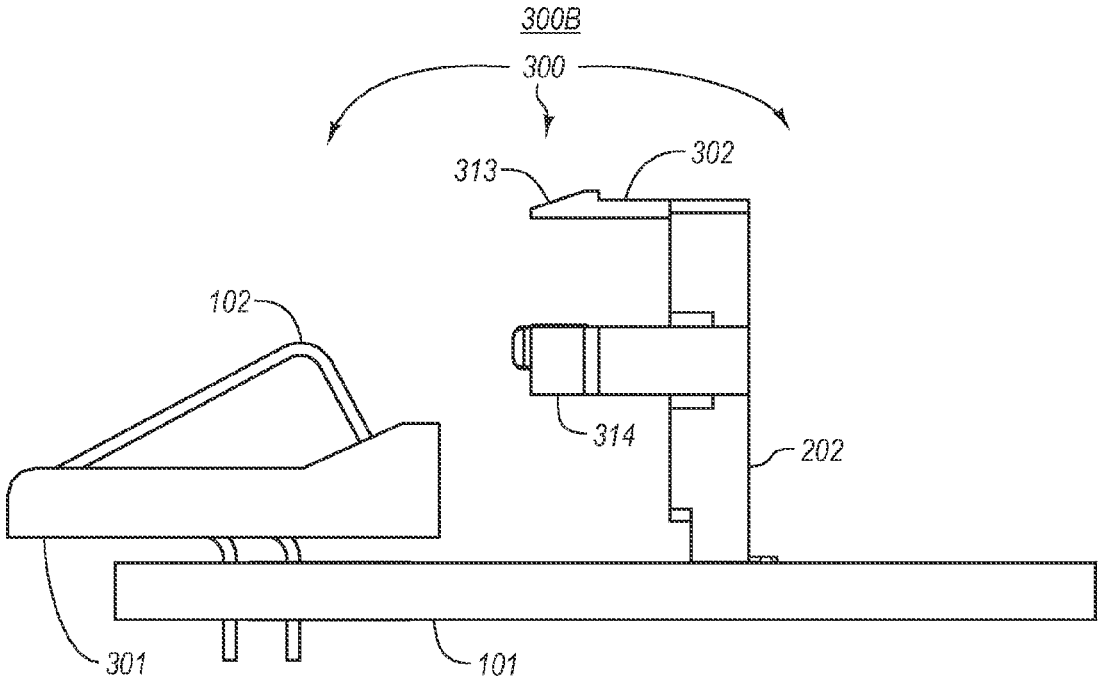
FIG. 3B illustrates a side perspective view of the components of the receptacle of FIG. 3A.
Figure 3C:
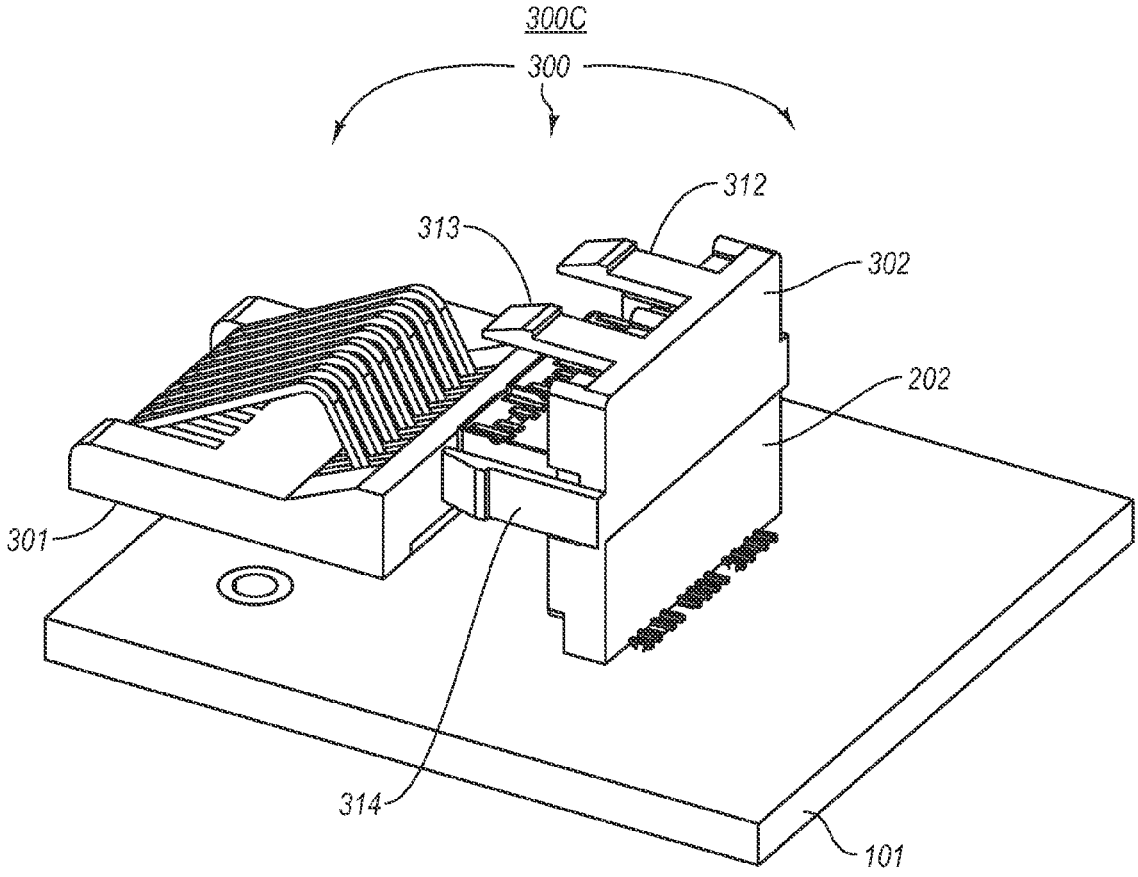
FIG. 3C illustrates a top back perspective view of the components of the receptacle of FIGS. 3A and 3B.

The RJ-45 contact alignment retainer 201 helps to retain the RJ-45 contact set 102 in place and to maintain the proper spacing of the contacts at each end. Such a contact alignment retainer 201 may be found in a typical RJ-45 compatible receptacle, though in those typical RJ-45 connectors the free end of the contacts are usually guided in grooves along the back surface (with respect to the plugging direction) of the receptacle opening. The LASERWIRE contact body 202 may be insert molded around the receptacle contacts or individual leads may be pressed into a plastic body and the free ends at the host PCB surface bent at 90 degrees to exit the desired direction and to lock them into the plastic body. However, a portion of the contacts is left exposed to facilitate effective insert molding. The contact body 202 includes three protrusions 203A through 203C, that each includes a contact group for contacting corresponding contact groups of the LASERWIRE connector. As discussed, the grouping of contact sets allows the openings through which allows the minimization of the electromagnetic radiation which will be emitted from the LASERWIRE plug body. It should be clear to one of ordinary skill in the arts, after having read this description, that the subdivision of the LASERWIRE contacts into three groups is not a required feature for the present invention FIGS. 3A through 3C illustrate a respective top front perspective view 300A, side view 300B, and top back perspective view 300C of components 300 of the receptacle. The components 300 of FIGS. 3A through 3C add to the components 200 of FIGS. 2A through 2C, except that a RJ-45 contact base 301 and a LASERWIRE contact top cover/housing anchor 302 are also shown.

The RJ-45 contact base 301 further helps position the RJ-45 contact set 102 in place. Furthermore, the housing anchor 302 may also be molded, and affixed to the contact body 202. The housing anchor 302 covers the previously exposed portion of the contact set 103. The housing anchor 302 also includes several prongs 311, 312, 313 and 314. The prongs 311 through 314 will assist in providing structural support for the receptacle housing, as will be described with respect to subsequent figures. In one example assembly, an RJ-45 contact set subassembly may be manufactured (perhaps even well in advance) to include the contact set 102, the contact alignment retainer 201, and the contact base 301, prior to electrically bonding the RJ-45 contact set subassembly to the printed circuit board 101. It should be noted that a single molded piece may serve the functions of both elements 201 and 301, and a single molded piece may server the function of both elements 202 and 302. While not shown in these figures, element 202 or 302 or both may include features to retain those pieces with the contact set 102 into the overall housing. These features may be similar to and would serve the same functions as prongs 311, 312, 313 and 314. Element 301 may also include features (such as a non-conducting post) which would couple with a hole on the host PCB to provide lateral alignment strength. The same posts could also be formed with features which would retain the completed assembly onto the host such as by splitting the post down its length and providing a positive latch shape at the far end of the post which expands along the far side of the host board to proven the structure from being removed and to provide strain relief for the soldered contacts. Also, the LASERWIRE contact set subassembly may also be pre-manufactured to include the contact set 103, the contact body 202, and the housing anchor 302 prior to electrically bonding the LASERWIRE contact set subassembly to the printed circuit board 101.

Figure 3D:
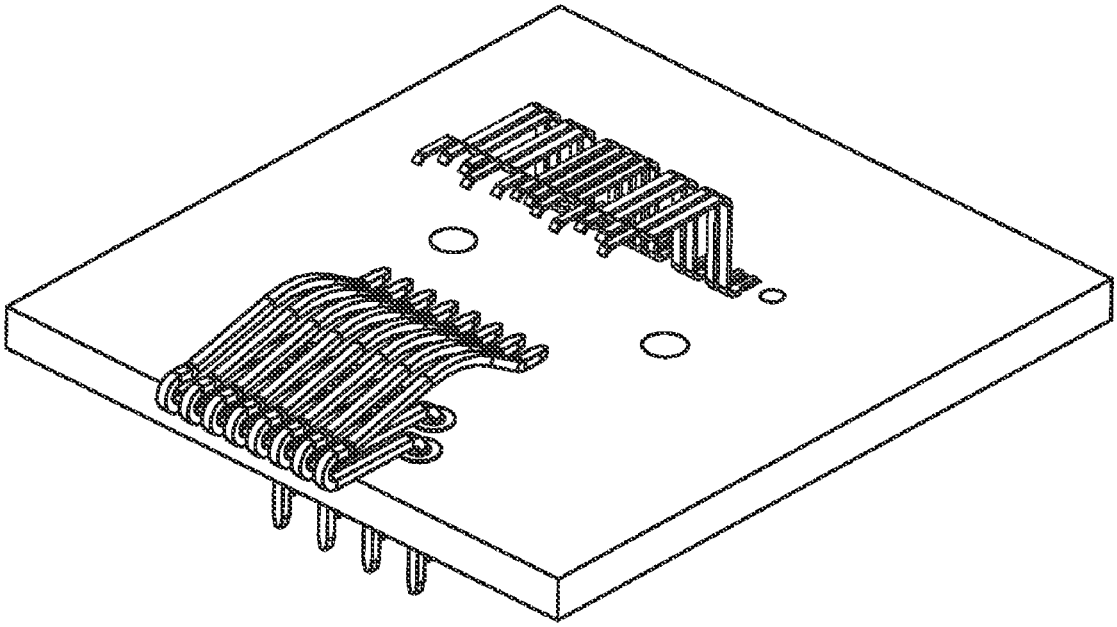
FIG. 3D illustrates an alternative implementation of the components of FIG. 3A in which just the contacts are shown.
Figure 3E:
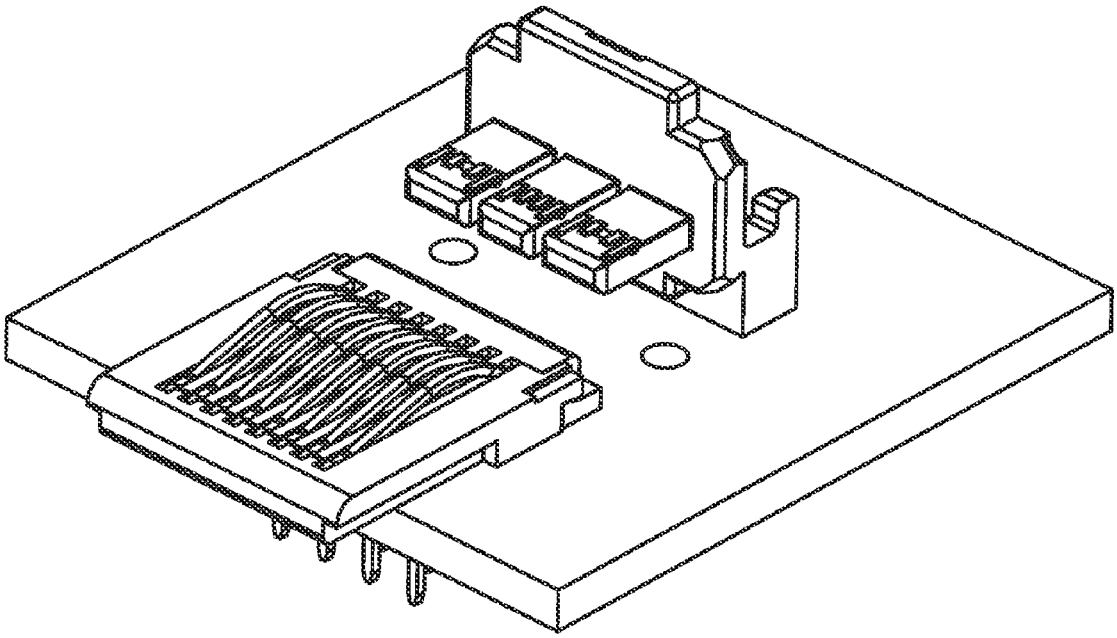
FIG. 3E illustrates the alternative implementation of the components of FIG. 3D with the contacts further supported.

FIGS. 3D and 3E illustrates an alternative configuration 1300D and 1300E for the contacts of the receptacle of FIGS. 3A through 3C. That said, the precise configuration of the contacts is not critical to the broader principles described herein so long as the appropriate contacts make electrical contact with the appropriate connector when that connector is plugged into the receptacle.

Figure 4:
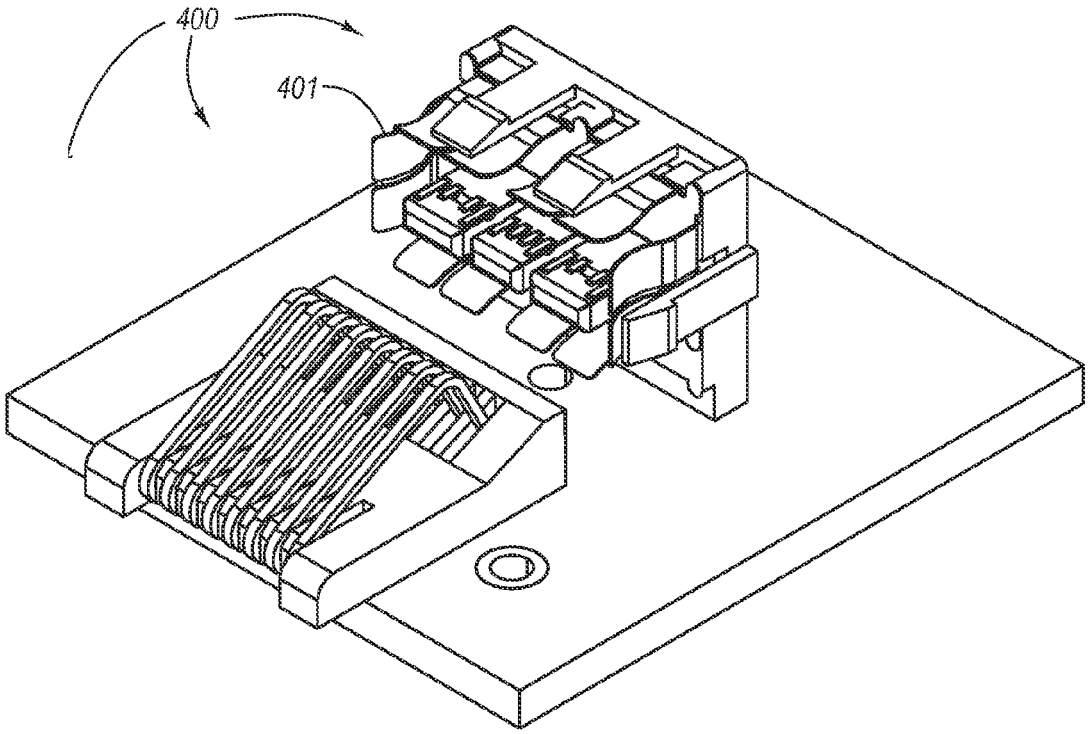
FIG. 4 illustrates a top front perspective view of components of the receptacle of FIGS. 3A through 3C, but with a socket shield added.

FIG. 4 illustrates a respective top front perspective view of components 400 of the receptacle. The components 400 of FIG. 4 add to the components 300 of FIGS. 3A through 3C in that a socket shield 401 is further shown. The socket shield 401 may also be considered a component of the LASERWIRE contact set subassembly, and thus may be fixed to the subassembly prior to the subassembly being electrically coupled with the printed circuit board. The socket shield 401 may alternatively be affixed even after the LASERWIRE contact set subassembly is affixed to the printed circuit board.

The socket shield 401 serves as a component of the EMI barrier between the host and the ambient environment reducing the coupling of (usually high frequency) electromagnetic radiation generated within the plug assembly or the host into the environment. In addition, the socket shield 401 completes the EMI shield of the LASERWIRE connector when the LASERWIRE connector is plugged into the receptacle. Thus, when a LASERWIRE connector is plugged in, the socket shield 401 serves as an EMI barrier between the LASERWIRE connector and the host and between the LASERWIRE connector and the environment as well.

The socket shield 401 may be composed of conductive material, such as metal, and includes several fingers that make electrical contact with the sleeve 1501 of the LASERWIRE connector 1000 (see FIG. 15 and accompanying description) as well as the body of the overall receptacle assembly, when the connector 1000 is plugged into the receptacle. The socket shield 401 extends to cover the front of the connector housing 1241 (introduced in FIGS. 12A through 12G), except at the area of openings 1211 through 1213. These small openings in the socket shield are the largest openings in the connector and host EMI barrier and serve to limit EMI better that a single large opening would. At high frequencies, such as 5 GHz and above, the attenuation of an opening increases very rapidly as the opening size becomes small with respect to the wavelength radiation. The smaller openings are facilitated by the breaking up of the electrical contacts into three spatially distinct groupings as described below with respect to FIGS. 12A through 12E.

Figure 5A:
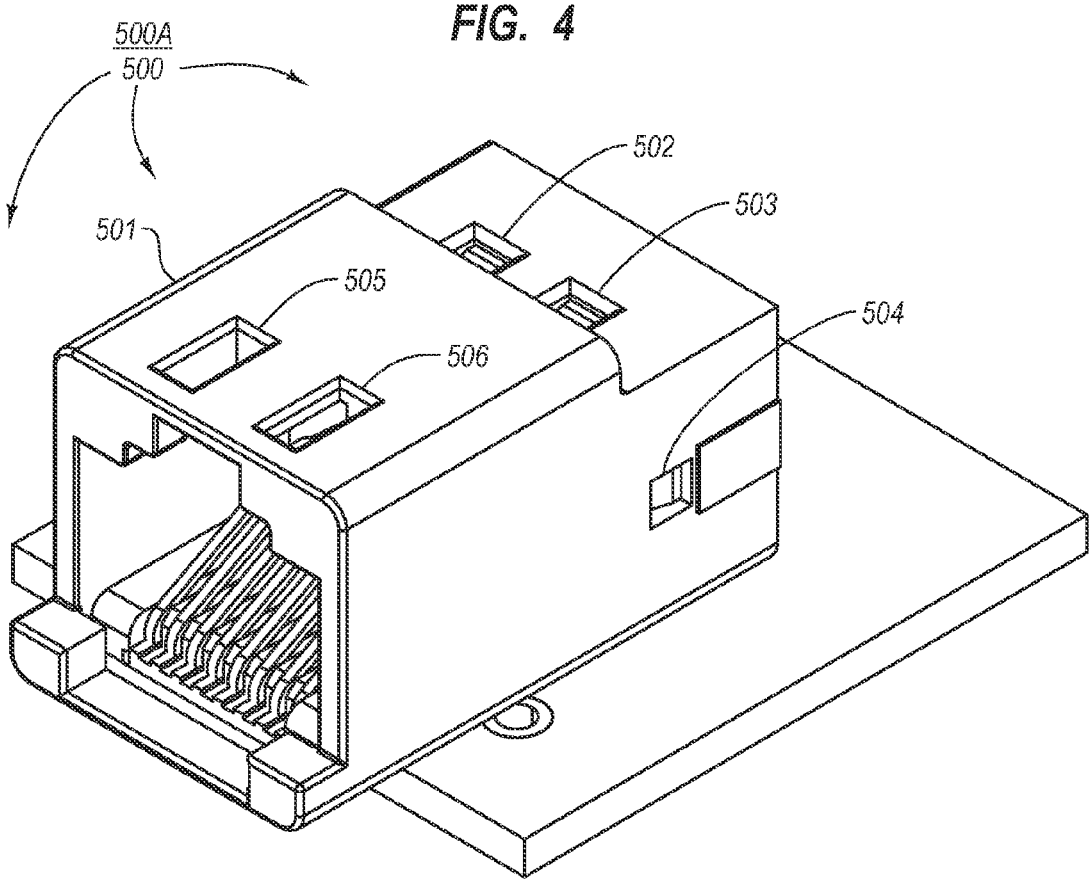
FIG. 5A illustrate a top front perspective view of the receptacle of FIG. 4, but with a receptacle housing also shown.
Figure 5B:
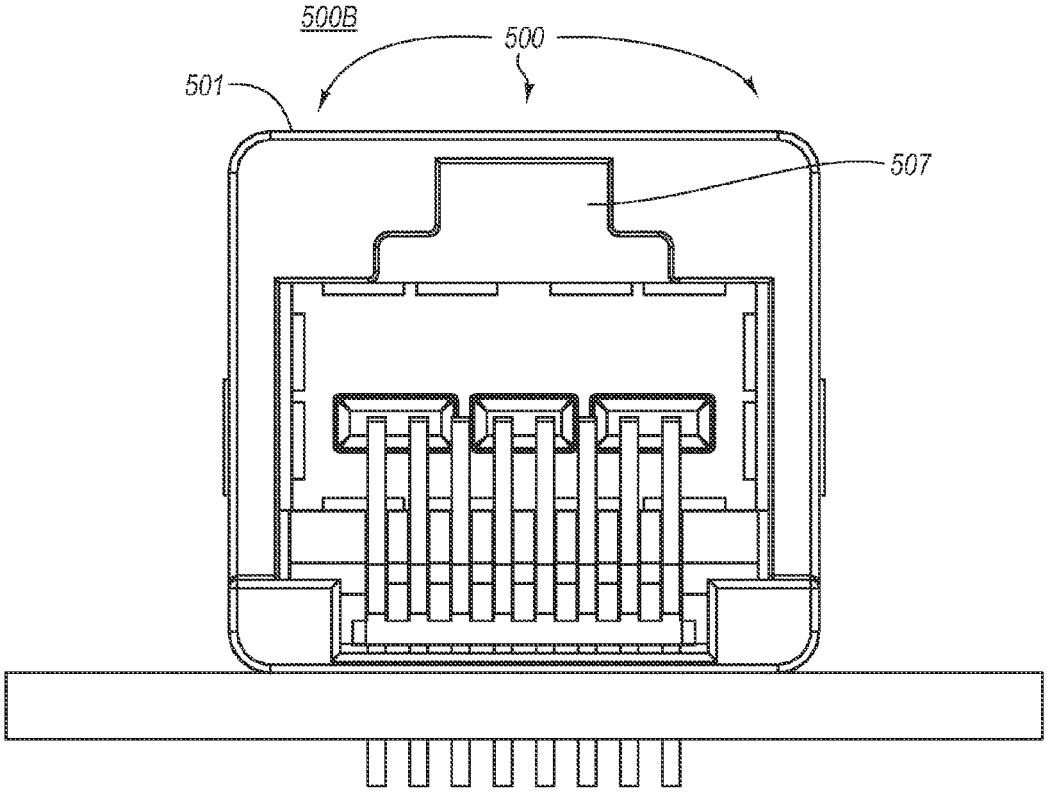
FIG. 5B illustrate a front view of the receptacle of FIG. 5A.
Figure 5C:
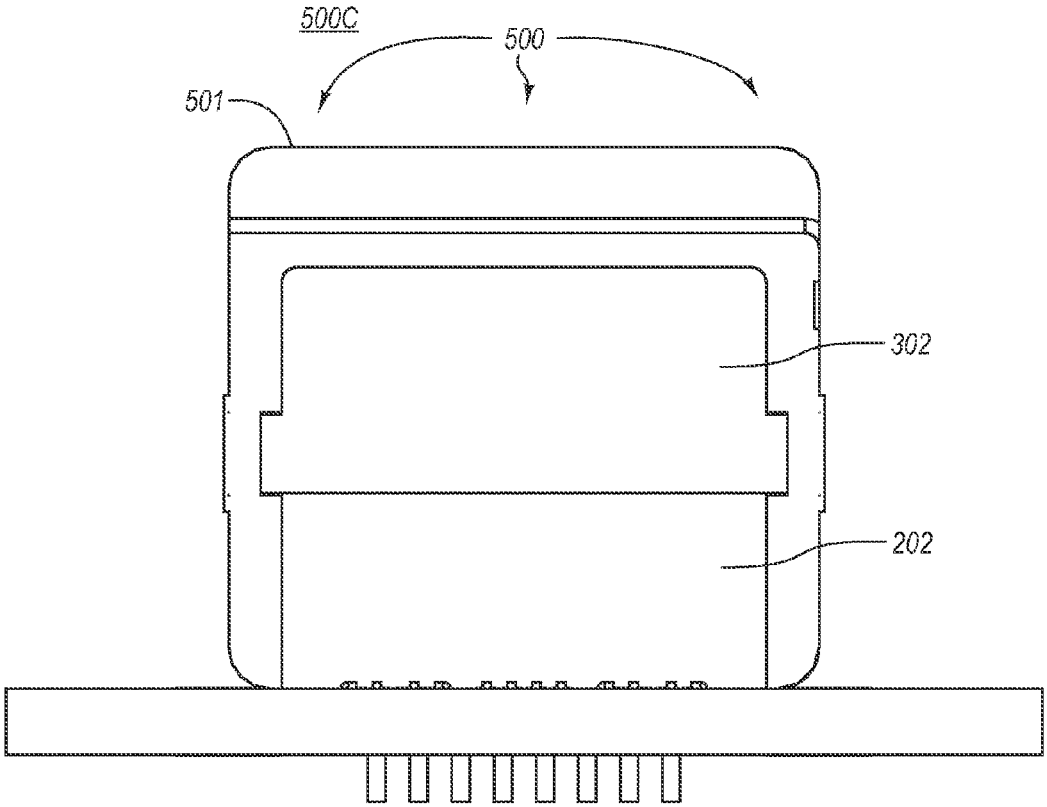
FIG. 5C illustrate a back view of the receptacle of FIGS. 5A and 5B.

FIGS. 5A, 5B and 5C illustrate a top front perspective view 500A, front view 500B, and back view 500C of the receptacle 500. The receptacle 500 adds to the components 400 of FIG. 4 by also showing the receptacle housing 501. The receptacle housing 501 includes holes that corresponding to the prongs 311 through 314. For instance, holes 502 through 504 receive prongs 312 through 314. There is yet another hole on the far side of the receptacle housing 501 that receives the prong 311. Similar features may also be added to retain the RJ-45 contact. The receptacle housing 501 also includes holes 505 and 506 to assist in latching either the RJ-45 or the LASERWIRE plug connector in place.

Figure 6A:
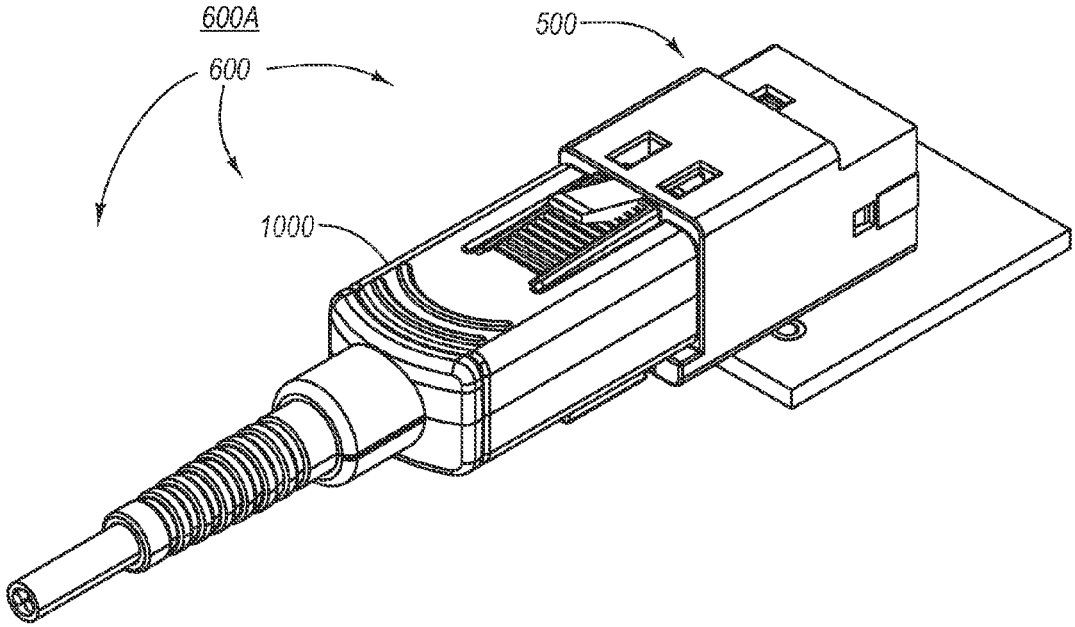
FIG. 6A illustrate a top front perspective view of a LASERWIRE™ connector plugged into the receptacle of FIGS. 5A through 5C.
Figure 6B:
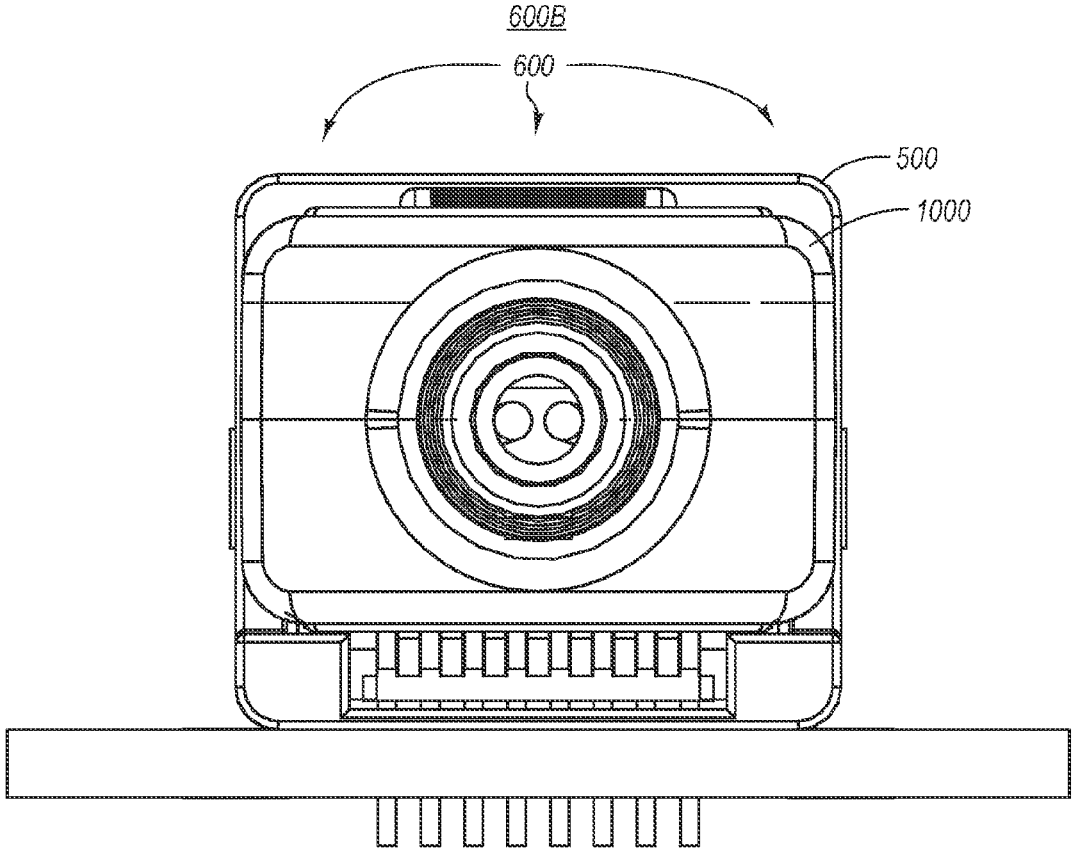
FIG. 6B illustrate a front perspective view of a LASERWIRE connector plugged into the receptacle of FIGS. 5A through 5C of FIGS. 5A through 5C.
Figure 6C:
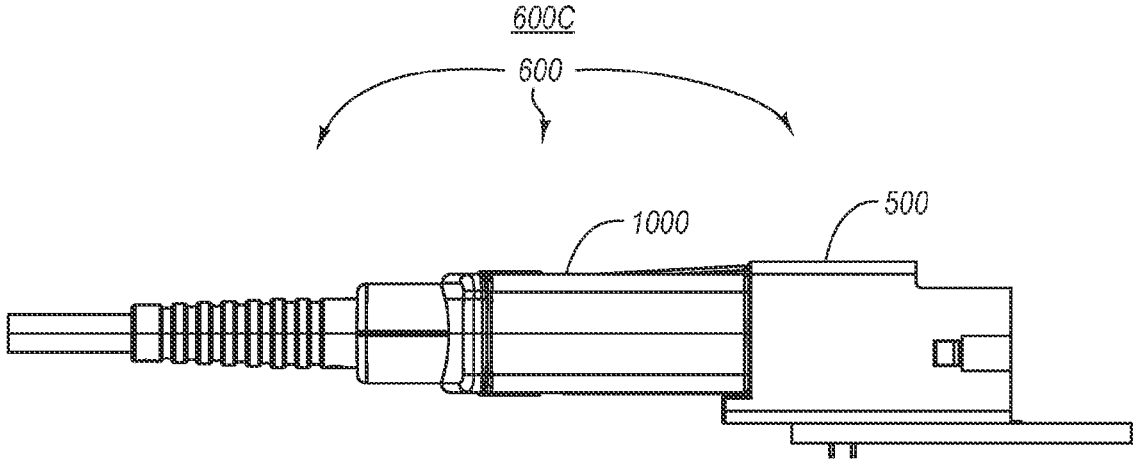
FIG. 6C illustrate a side perspective view of a LASERWIRE connector plugged into the receptacle.

FIGS. 6A through 6C illustrate a top front perspective view 600A, front view 600B, and side view 600C of a LASERWIRE connector 1000 (as described with respect to FIGS. 10A through 22D) plugged into the receptacle 500. In this state, the connector contacts 1106 of the LASERWIRE connector (see contacts 1106 of FIGS. 11A through 11E and corresponding description) come into contact with the receptacle-side contact set 103 (see FIGS. 1A through 1C). This establishes an electrical coupling between the connector 1000 and receptacle 500.

As a side note, the contact set 102 intended for the RJ-45 connector comes into contact with the bottom-side of the sleeve 1501 of the connector, causing the contact set 102 to bend downwards. In order to avoid shorting the contact set 102, the bottom-side of the sleeve 1501 may be coated with an electrically insulating coating. Alternatively, the contact set 102 may simply be left to contact the conductive sleeve 1501. RJ-45 based Ethernet standards (most importantly 10BASE-T, 100BASE-TX and 1000BASE-T) require that the circuitry connected to the RJ-45 contact set has a mechanism to address short circuits without harming any part of the host system circuitry. Accordingly, a short circuit of the contact set 102 may not be a critical issue to avoid in the receptacle 500 or connector 1000 design. Nevertheless, to avoid the short circuit issue, the sleeve 1501 of the LASERWIRE connector or a portion thereof may be coated with mechanically robust insulation if desired.

Figure 7A:
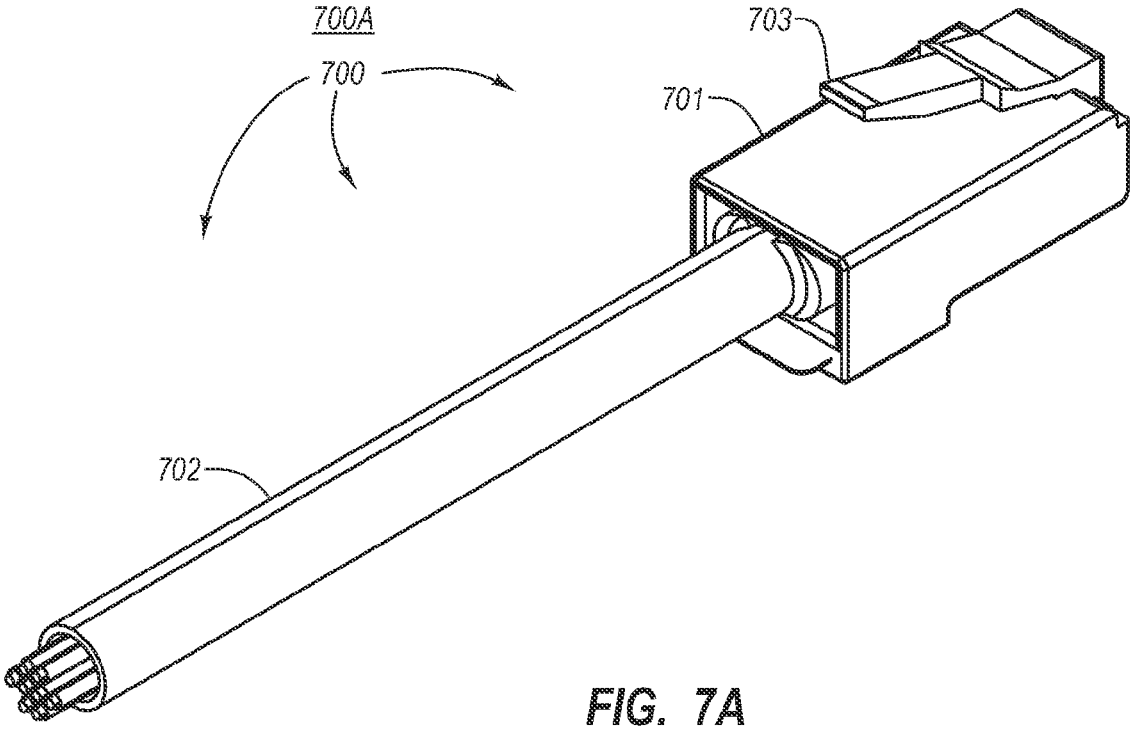
FIG. 7A illustrate a respective top front perspective view of a conventional RJ-45 connector plug as defined in the standard TIA-968-A.
Figure 7B:
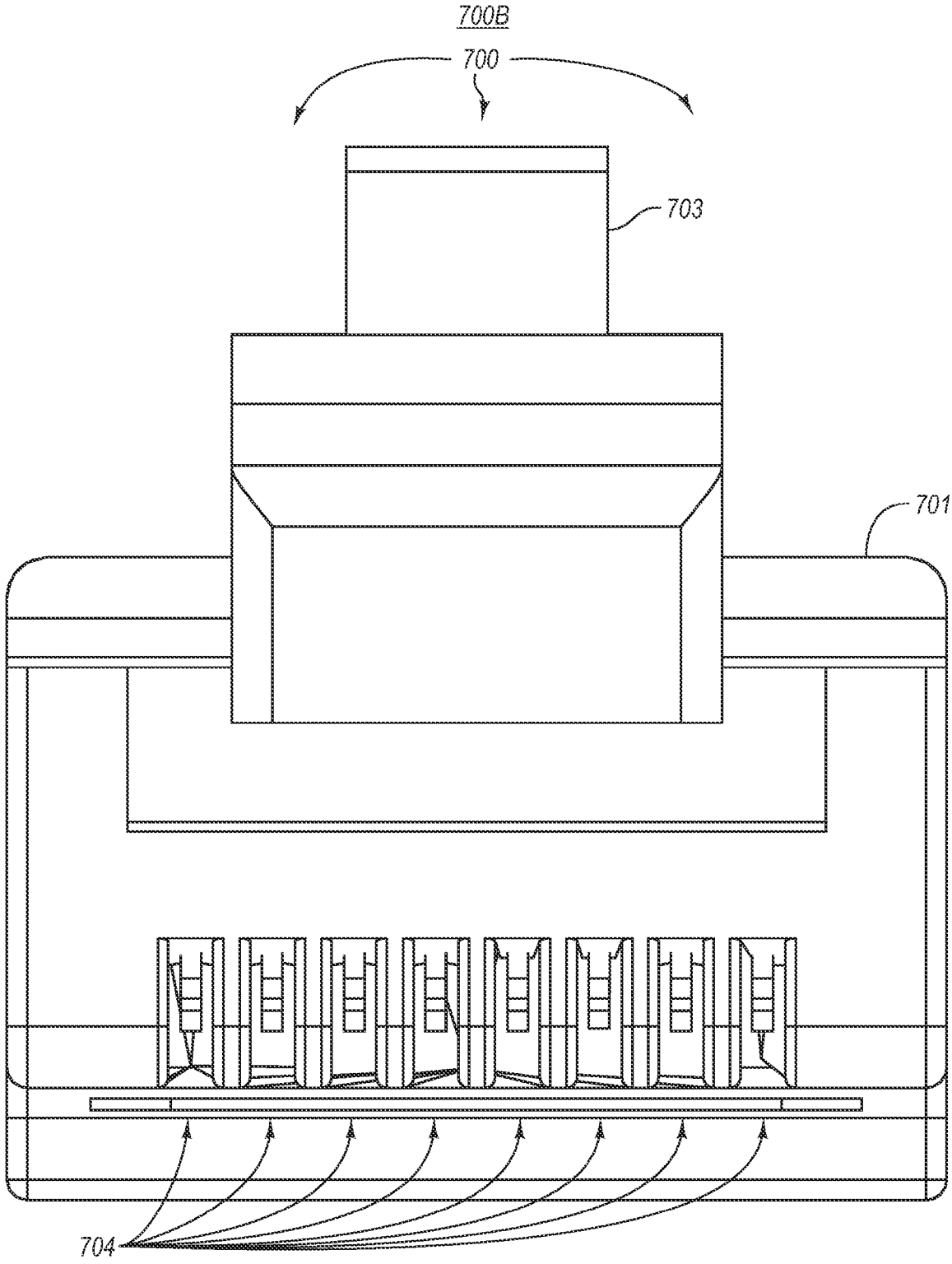
FIG. 7B illustrate a respective back perspective view of a conventional RJ-45 connector plug.

FIGS. 7A and 7B illustrate a respective top front perspective view 700A, and back view 700B of a conventional RJ-45 connector plug, 700. Recall that the nomenclature for "front" and the "back" directions set forth above when describing the receptacle is retained here. The connector 700 includes a cable housing 702 coupled to the connector end 701. The connector end 701 has a latch 703. The connector includes 8 contacts 704 as apparent from FIG. 7B and as well known to those familiar with conventional RJ-45 connectors and as defined in the standard TIA-968-A. The RJ-45 connector 700 may represent any conventional RJ-45 connector.

Figure 8A:
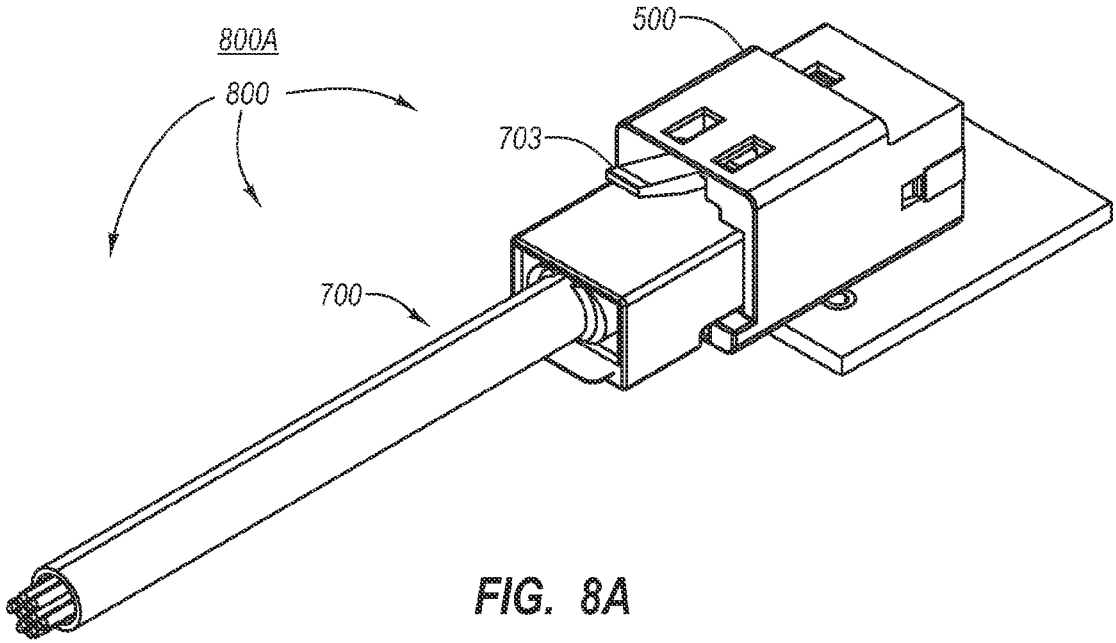
FIG. 8A illustrate a top front perspective view of the RJ-45 connector of FIGS. 7A and 7B plugged into the connector of FIGS. 5A through 5C.
Figure 8B:
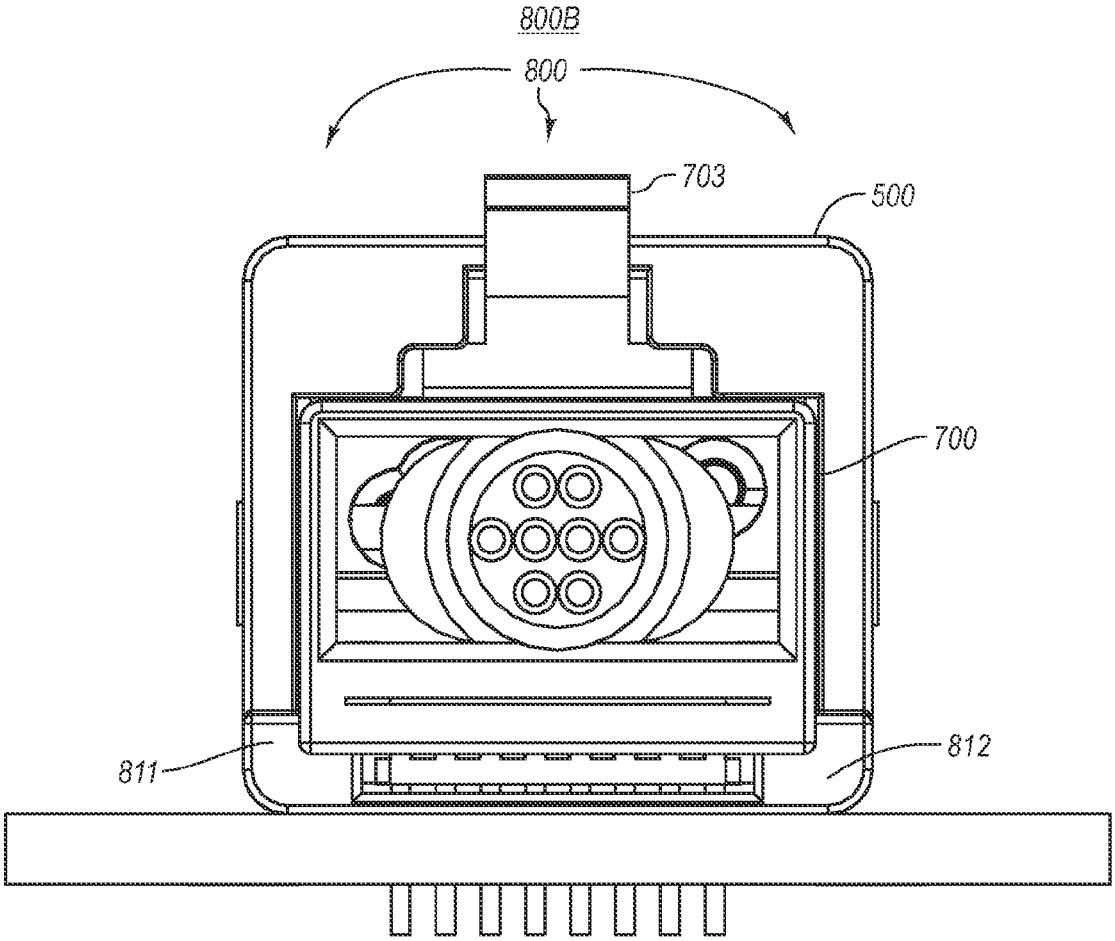
FIG. 8B illustrate a front view of the RJ-45 connector of FIGS. 7A and 7B plugged into the connector of FIGS. 5A through 5C.
Figure 8C:
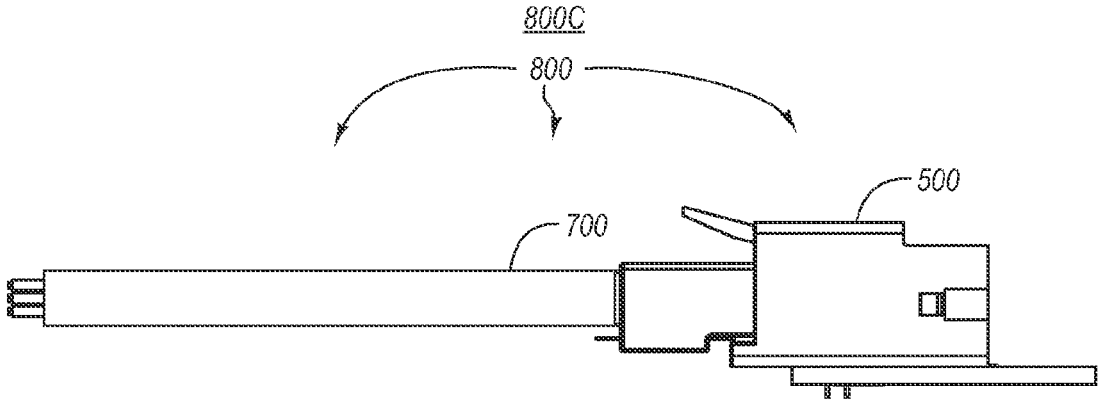
FIG. 8C illustrate a side view of the RJ-45 connector of FIGS. 7A and 7B plugged into the connector of FIGS. 5A through 5C.

FIGS. 8A through 8C illustrate a respective top front perspective view 800A, front view 800B, and side view 800C of the RJ-45 connector 700 plugged into the connector 500. In this state, the connector contacts 704 make contact with the contact set 102 of the receptacle 500, thereby electrically coupling the RJ-45 connector 700 with the receptacle 500. Also in this state, the latch 703 engages with the holes 505 and 506 of the connector housing 500, and feature 507 which limits the extent of the forward movement of the connector plug.

The RJ-45 cannot be inserted into the receptacle deep enough to contact the other contact set 103 intended for the LASERWIRE connector. The feature 507 provides a mechanical barrier that prevents the RJ-45 connector from being inserted too far into the receptacle. The features 811 and 812 are provided to prevent downward tilting of the LASERWIRE plug, and provide additional support for a LASERWIRE connector when the LASERWIRE connector is plugged into the receptacle.

Figure 9:
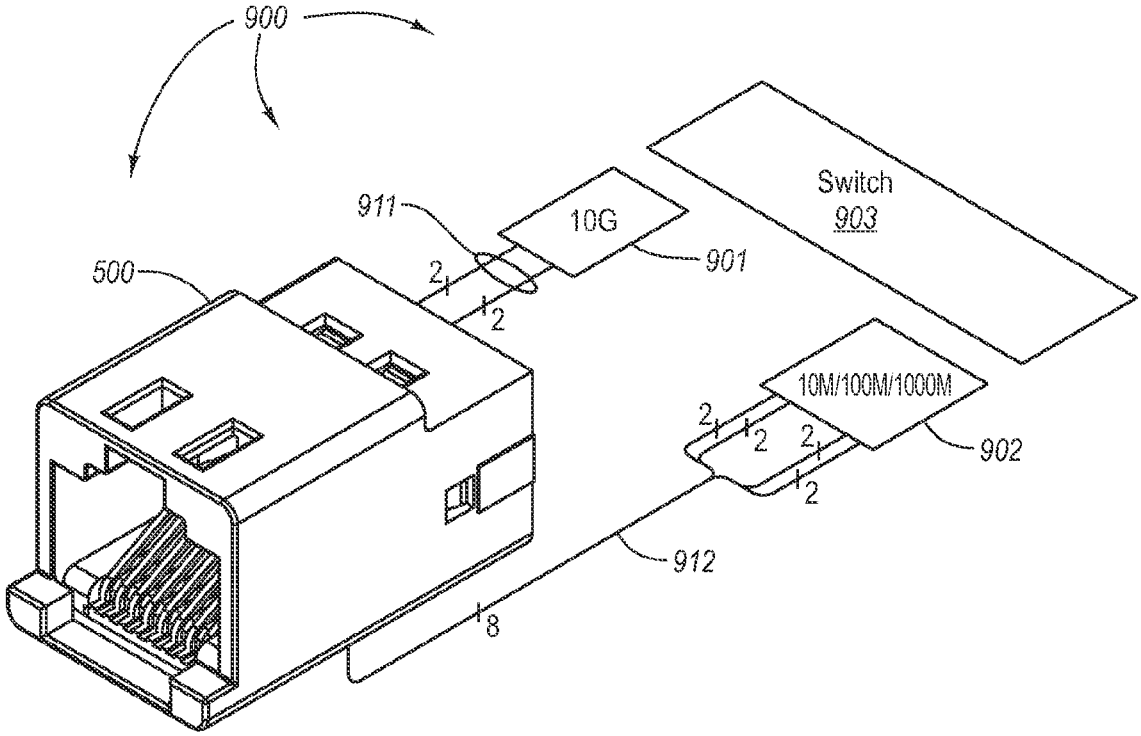
FIG. 9 illustrates a schematic diagram of a physical layer circuitry for controlling the operation of the receptacle.

FIG. 9 illustrates a schematic diagram of a physical layer circuitry 900 for controlling the operation of the receptacle. When a LASERWIRE connector is plugged into the receptacle 500, transmit and receive signals 911 may be dispatched from and to the LASERWIRE PHY 901. In this state, there are not signals that are passed between the RJ-45 PHY 902 and the receptacle 500. The switch 903 or other higher level circuitry is capable of detecting the presence of the LASERWIRE connector, and may power down the RJ-45 PHY 902 in order to conserve power. For example, one of the contacts of the LASERWIRE may be for presence detection. For instance, perhaps the corresponding receptacle contact is typically pulled high through a relatively high value resistor (e.g. 4.7 kOhms), and the corresponding plug contact is directly grounded or pulled low with a lower value resistor (e.g. 470 Ohms). The receptacle contact will thus be high, unless the LASERWIRE connector is plugged in. The switch 903 may directly or indirectly use this signal to thereby detect the presence of the LASERWIRE connector. If the presence of the LASERWIRE connector is not detected, the switch 903 may control the RJ-45 PHY 902 to be powered on, and the LASERWIRE PHY 901 to be powered off. This would allow for communication between the RJ-45 PHY 902 and the receptacle 500 via traces 912. The illustrated traces 911 and 912 are illustrated symbolically, and may be traces within the printed circuit board 101, for example. The PHYs 901 and 902, and the switch 903 may be circuitry electrically coupled to the printed circuit board 101, and/or embedded in the printed circuit board 101.

Typically, there must be various magnetic elements (transformers) both in series with and parallel to the RJ-45 contacts (a minimum of 4 elements but often 8 or even 12). These elements provide an electrical isolation of common mode signals, including large DC voltages between the systems. These elements are often provided as a discrete component (or array of sets for multiple ports), commonly known as the hybrid circuitry, on the host board. One potentially useful variation of the present invention would integrate these magnetic components within the connector body as is often done in RJ-45 receptacles intended for Ethernet applications.

In one embodiment, the LASERWIRE PHY 901 may be configured to operate at a data rate of 10 Gbps. On the other hand, the RJ-45 PHY 902 may be configured to operate at typical RJ-45 speeds, which may be 10 Mbps, 100 Mbps, or 1000 Mbps data rates. This multirate capability of RJ-45 based PHYs is quite standard and written into the associated IEEE specifications for the 100 Mb and 1000 Mb standards. The RJ-45 PHY may be a typical RJ-45 PHY, except that it responds to power-up signals and power-down signals from the switch 903.

Accordingly, a receptacle and corresponding control mechanism is described that allows the receptacle to operate with different connector types, where each connector type uses a distinct contact set in the receptacle. This permits for more varied usage of the receptacle, thereby providing more options in data rates and cables using a single receptacle.

One of the electrical connectors that may be plugged into the plural use connector is referred to herein as a "LASERWIRE" connector. The structure of such a connector will now be described with respect to FIGS. 10 through 22D. The LASERWIRE electrical connector has reduced electromagnetic interference (EMI) and may be mechanically configured to mate with an appropriate receptacle, such as that described above with respect to FIGS. 1A through 9. The receptacle may be positioned on a host machine, or any other external computer, machine or device. When the electrical connector mechanically mates with an appropriate receptacle, at least some of the electrical contacts of the electrical connector make electrical contact with at least some of the electrical contacts of the corresponding receptacle. While not limited to this application, this connector is well suited for use in an active optical cable where the connector described herein is the external interface, but the actual data transmission is over a pair of optical fibers.

Figure 10A:
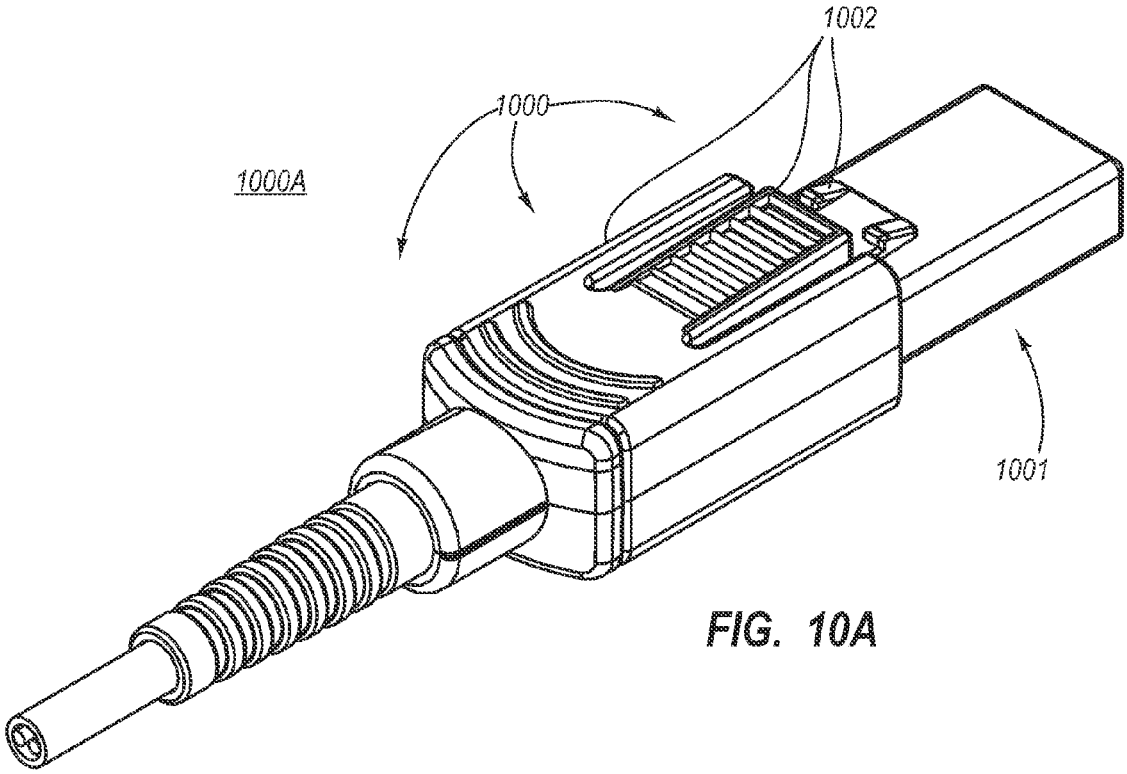
FIG. 10A illustrates a top rear perspective view of an electrical connector representing one embodiment of a connector described herein.
Figure 10B:
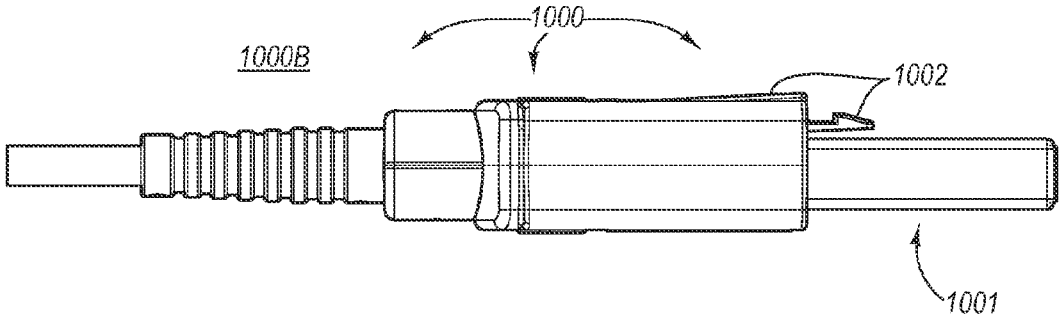
FIG. 10B illustrates a side view of the electrical connector of FIG. 10A.
Figure 10C:
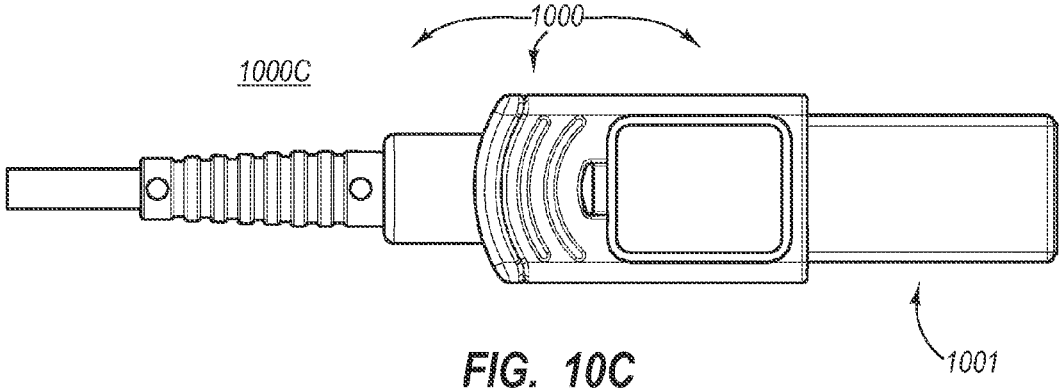
FIG. 10C illustrates a bottom view of the electrical connector of FIGS. 10A and 10B.

FIGS. 10A, 10B and 10C illustrate a respective top rear perspective view 1000A, side view 1000B, and bottom view 1000C of an electrical connector 1000 representing one embodiment of a connector described herein. The connector 1000 includes an insertion portion 1001 that may be inserted into a receptacle, whereupon a latch 1002 may mechanically engage with the receptacle to lock the connector 1000 into place within the receptacle until the next time the latch 1002 is disengaged. The latch 1002 engages with the receptacle by simply pushing the insertion portion 1001 into the receptacle, causing the latch 1002 to depress downwards as the latch 1002 engages the receptacle. The structure of the receptacle permits the latch 1002 to springs back up into a mechanically locked position within the receptacle once the insertion portion 1001 of the connector 1000 is fully inserted into the receptacle. The latch 1002 is disengaged from the receptacle by pressing downward on the latch 1002, allowing the latch 1002 to once again move freely out of the receptacle.

In this description, "front side" with respect to a connector means the electrical interface side of the connector closer to the insertion portion, while "rear side" means the side of the connector closer to the cable. "Top side" means the side of the connector that includes the latch, whereas "bottom side" means the side of the connector opposite the latch. This terminology will be consistent throughout this appendix when referring to a connector or a view of a connector, even if other components (such as a host receptacle and/or adaptors) appear in the view.

First, a detailed construction of the connector 1000 will be described with respect to FIGS. 11A through 22D. Then, a variation in methods for terminating an optical fiber in an active optical cable implementation will be described.

First, the connector structure will be described. In describing particular connectors, it will be understood by those of ordinary skill in the art, after having read this description, that the principles of the design applied to the connector described in this description may be applied broadly to reduce EMI in any variety of electrical connectors.

Figure 11A:
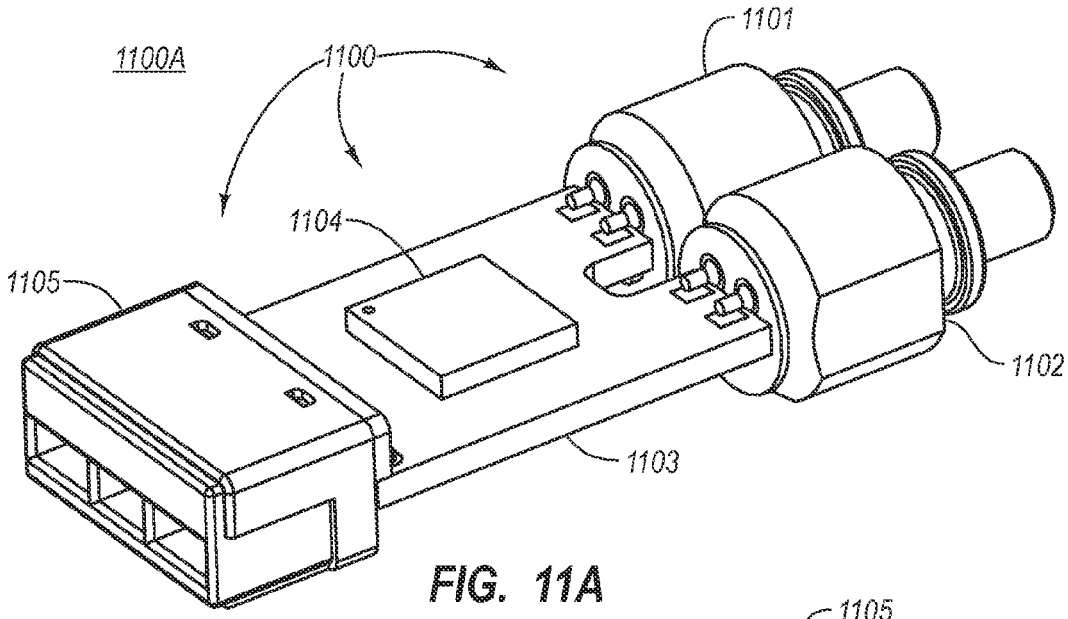
FIG. 11A illustrates a top front perspective view of several internal components of the electrical connector of FIGS. 10 through 10C.
Figure 11B:
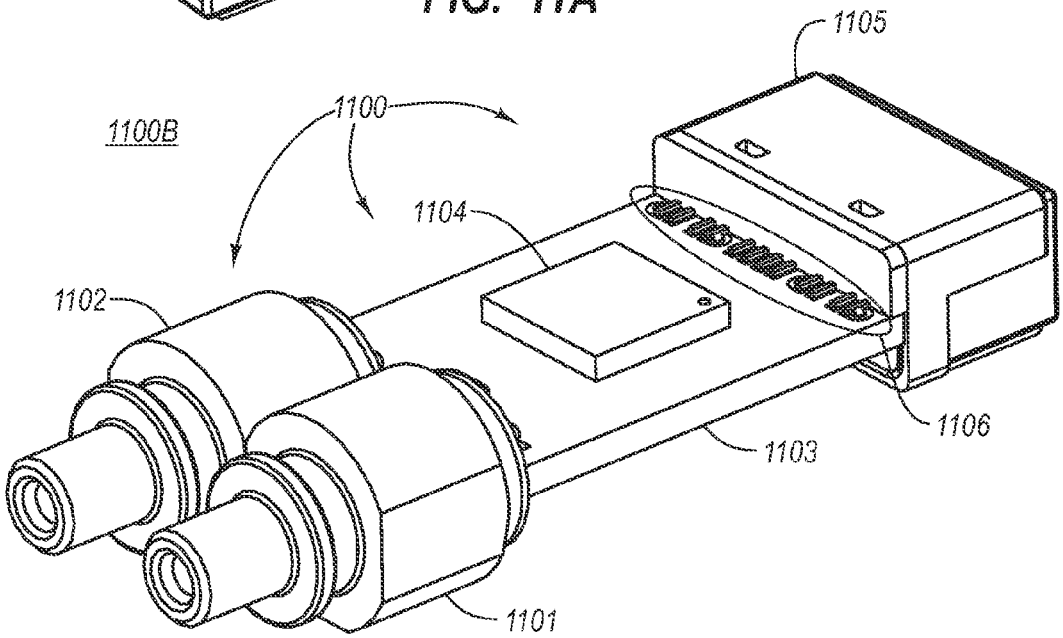
FIG. 11B illustrates a top rear perspective view of the internal components of FIG. 11A.

FIG. 11A illustrates a top front perspective view 1100A of several internal components 1100 of an active optical cable utilizing the present electrical connector. FIGS. 11B, 11C, 11D and 11E respectively illustrate a corresponding top rear perspective view 1100B, side view 1100C, front view 1100D, and bottom view 1100E of internal components 1100 of the electrical connector 1000 of FIGS. 10A through 10C. At this stage of the construction, the optical fibers are not yet shown. Only portions of the connector itself are shown.

The internal components 1100 include a printed circuit board 1103 having mounted thereon an integrated circuit 1104. The integrated circuit 1104 may have thereon any circuit advantageous or useful in converting electrical signals into optical signals and vice-versa. For instance, the integrated circuit 1104 may include a laser driver, post amplifier, limiting amplifier, trans-impedance amplifier, controller, or any other desirable circuitry. The printed circuit board 1103 communicates electrical signals to a Transmit Optical Sub-Assembly (TOSA) 1101, which will eventually operate to convert such electrical signals into an optical transmit signal that will be transmitted into a transmit optical fiber (not yet shown in FIGS. 11A through 11E, but shown in some subsequent figures). A Receive Optical Sub-Assembly (ROSA) 1102 will eventually operate to convert electrical signals received from a receive optical fiber (not yet shown) into electrical signals. The printed circuit board 1103 communicates such electrical signals to the integrated circuit 1104. The printed circuit board 1103 also communicates electrical signals to and from electrical contacts 1106 in electrical interface assembly 1105. Such electrical contacts 1106 will mechanically and electrically interface with the receptacle when the connector is plugged into the receptacle. Although FIGS. 11A through 11E illustrate a TOSA 1101, a ROSA 1102 and a printed circuit board 1103, such elements are not essential elements in accordance with the broadest principles described herein. For instance, the connector might be fabricated without a printed circuit board, with perhaps the TOSA and ROSA elements incorporated into Integrated Circuit (IC) packaging.

Figure 11C:
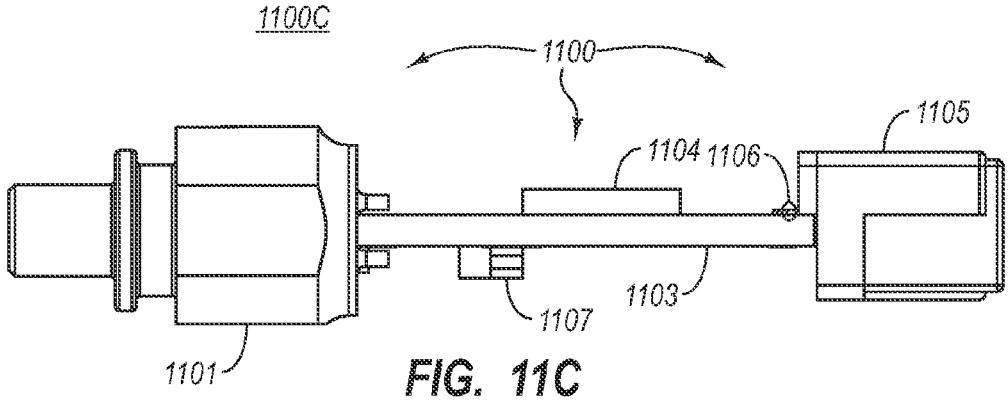
FIG. 11C illustrates a side view of the internal components of FIGS. 11A and 11B.
Figure 11D:
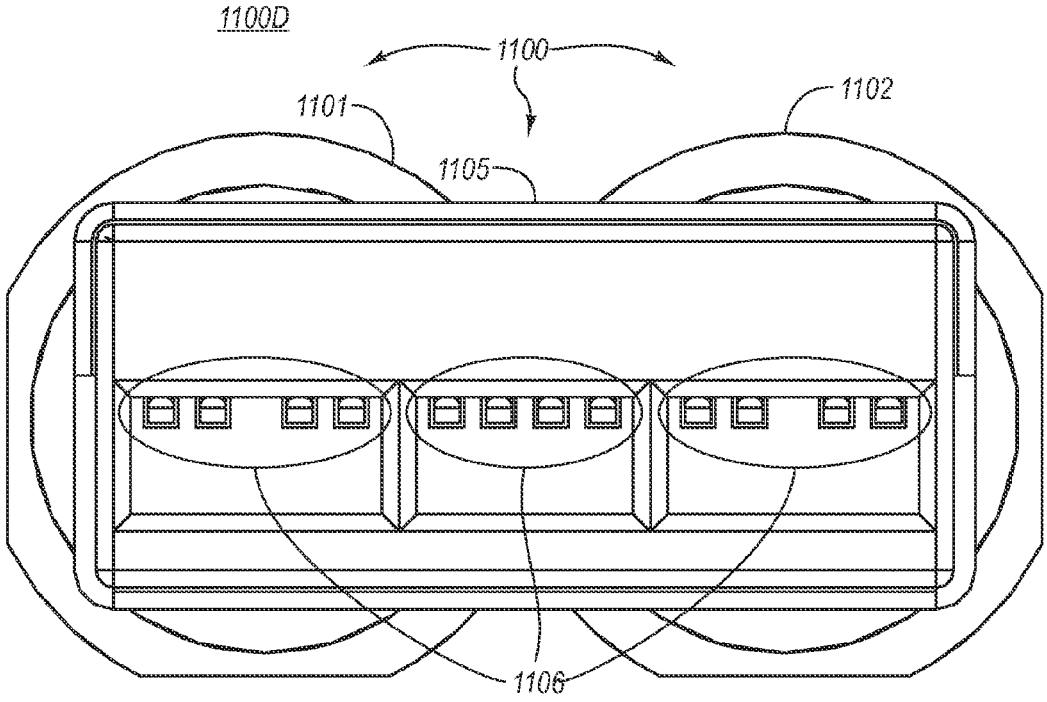
FIG. 11D illustrates a front view of the internal components of FIGS. 11A through 11C.
Figure 11E:
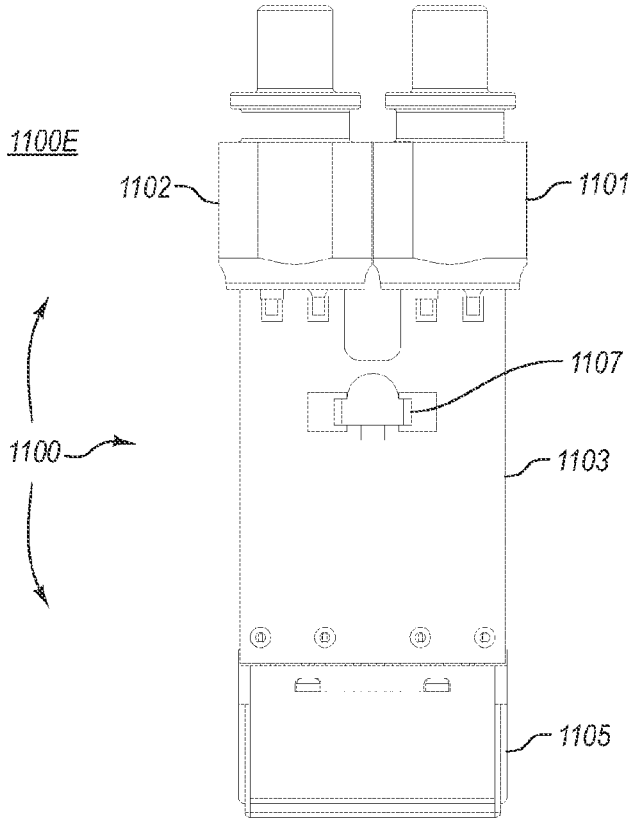
FIG. 11E illustrates a bottom view of the internal components of FIGS. 11A through 11D.

In one embodiment, a Light Emitting Diode (LED) 1107 is fixed on the bottom side of the printed circuit board 1103 as can best be seen from FIGS. 11C and 11E. The LED 1107 will be used as a light source to communicate status information to a user. Ultimately, as will be apparent from subsequent figures, the LED 1107 will channel light through an optical light guide (described further below) so as to emit visible light external to the connector. By this mechanism, status information may be visually communicated to a user.

The construction of the electrical interface assembly 1105 will be further described with respect to FIGS. 12A through 12E, which illustrated various components of the electrical interface assembly 1105 in various views and stages of construction. The electrical interface assembly 1105 may be manufactured in advance of the assembly of the connector 1000.

Figure 12A:
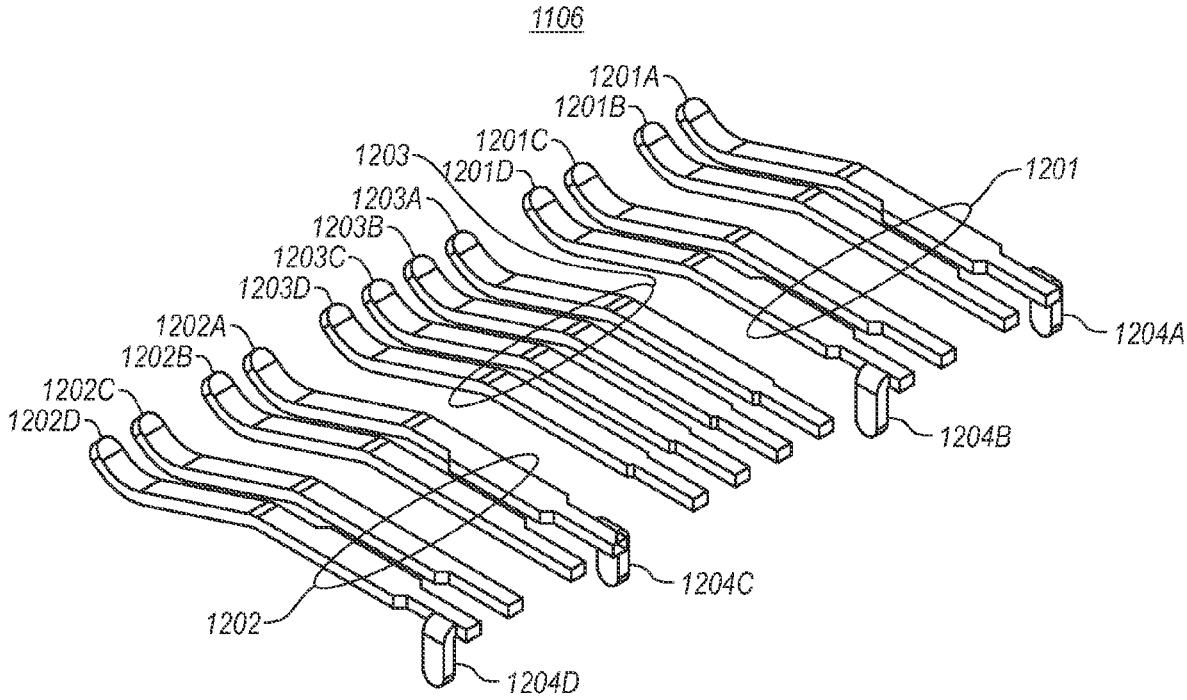
FIG. 12A illustrates a top rear perspective view of electrical contacts of the electrical interface assembly.

Referring to FIG. 12A, electrical contacts 1106 are segmented in several groups. For instance, the electrical contacts includes contact group 1201 including four contacts total (contacts 1201A, 1201B, 1201C and 1201D), contact group 1202 including four contacts total (contacts 1202A, 1202B, 1202C and 1202D), and contact group 1203 including four contacts total (contacts 1203A, 1203B, 1203C and 1203D). In subsequent figures, individual contacts may sometimes not be labeled in order to avoid unnecessarily complicating the figures. However, contact groups may more often be labeled. Each contact group 1201 through 1203 is separated from other groups by a particular distance. For instance, there is a larger gap between contacts 1201D and 1203A, and between contacts 1203D and 1202A.

In one embodiment, the contact group 1201 may be used for communicating differential electrical transmit signals (sometimes referred to in the art as TX+ and TX− signals) and also include two ground signals for improved signal quality. For instance, contacts 1201A and 1201D may be ground contacts, whereas contacts 1201B and 1201C may be TX+ and TX− contacts actually carrying the differential electrical transmit signal during operation. By controlling the distance between the differential transmit contacts 1201B and 1201C, and between each differential transmit contact and the neighboring ground contact 1201A or 1201D, the common mode impedance and differential mode impedance of the electrical transmit signal may be more closely controlled.

The contact group 1202 may be used for communicating differential electrical receive signals (sometimes referred to as RX+ and RX− signals) and also include two ground signals for improved signal quality. For instance, contacts 1202A and 1202D may be ground contacts, whereas contacts 1202B and 1202C may be RX+ and RX− contacts actually carrying the differential electrical receive signal during operation. Once again, by controlling the distance between the differential receive contacts 1202B and 1202C, and between each differential receive contact and the neighboring ground contact 1202A or 1202D, the common mode impedance and differential mode impedance of the electrical receive signal may also more closely controlled. Such common mode and differential mode impedance control serves to reduce signal degradation contributed by the contacts, which is especially important at high data rates.

Note that each of the ground contacts 1201A, 1201D, 1202A and 1202D have a respective post 1204A, 1204B, 1204C and 1204D. The posts may be inserted into existing ground holes in the printed circuit board 1103, to allow for secure grounding of the ground contacts. Furthermore, this allows for a more secure mechanical connection between the electrical interface assembly 1105 and the printed circuit board 1103, thereby perhaps improving reliability. The securing of the ground contact posts into corresponding ground holes of the printed circuit board might best be seen in FIG. 11B. However, the posts are not essential to the broader principles described herein.

The contact group 1203 may have contacts that serve purposes other than actually carrying the high speed electrical signal. For instance, the contacts 1203 may be used to power the integrated circuit 1104 and LED 1107, may carry far-side power for providing power through the cable itself ((if there is an electrical conductor also in the cable), may be used for a low speed serial interface (one wire or perhaps two wire), or any other desired purpose. One of the contacts in the contact group 1203 might be used to accomplish a connector presence detection function. For example, one of the contacts may be grounded, whereas the corresponding contact in the receptacle is pulled high. If the connector is plugged into the receptacle, the receptacle contact will then be drawn low, allowing the receptacle, and any connected host to identify that the connector is present.

Figure 12B:
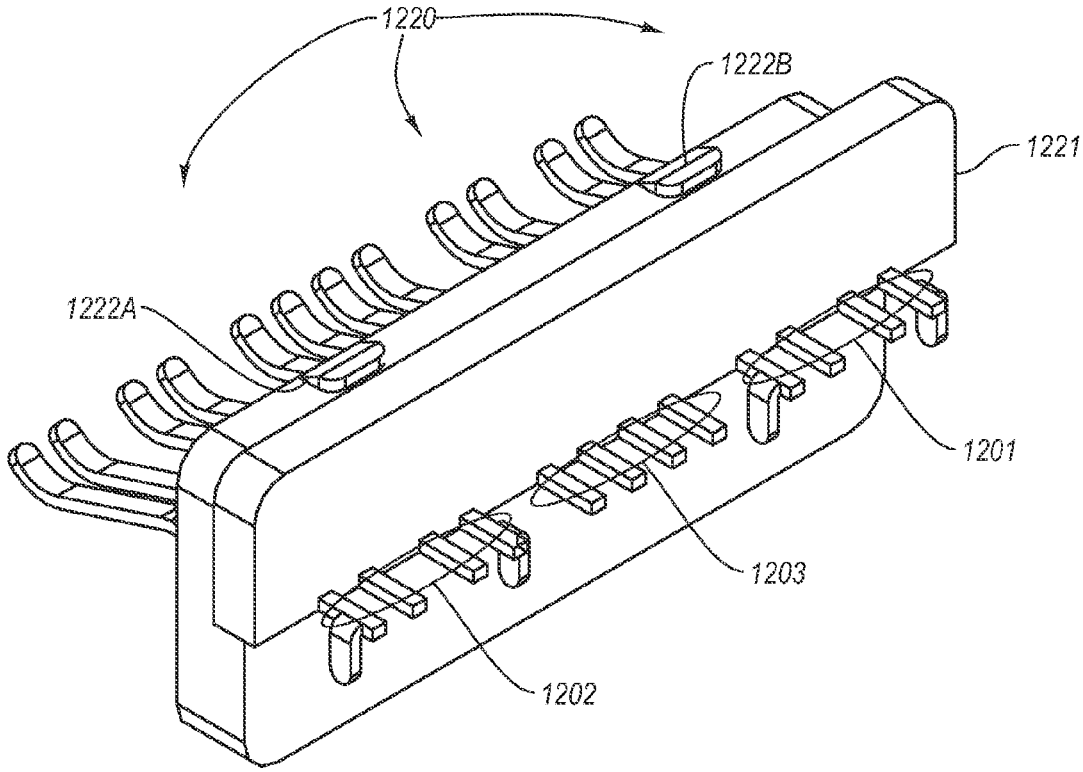
FIG. 12B illustrates a top rear perspective view of components of the electrical interface assembly including the electrical contact set of FIG. 12A being overmolded by a body.
Figure 12C:
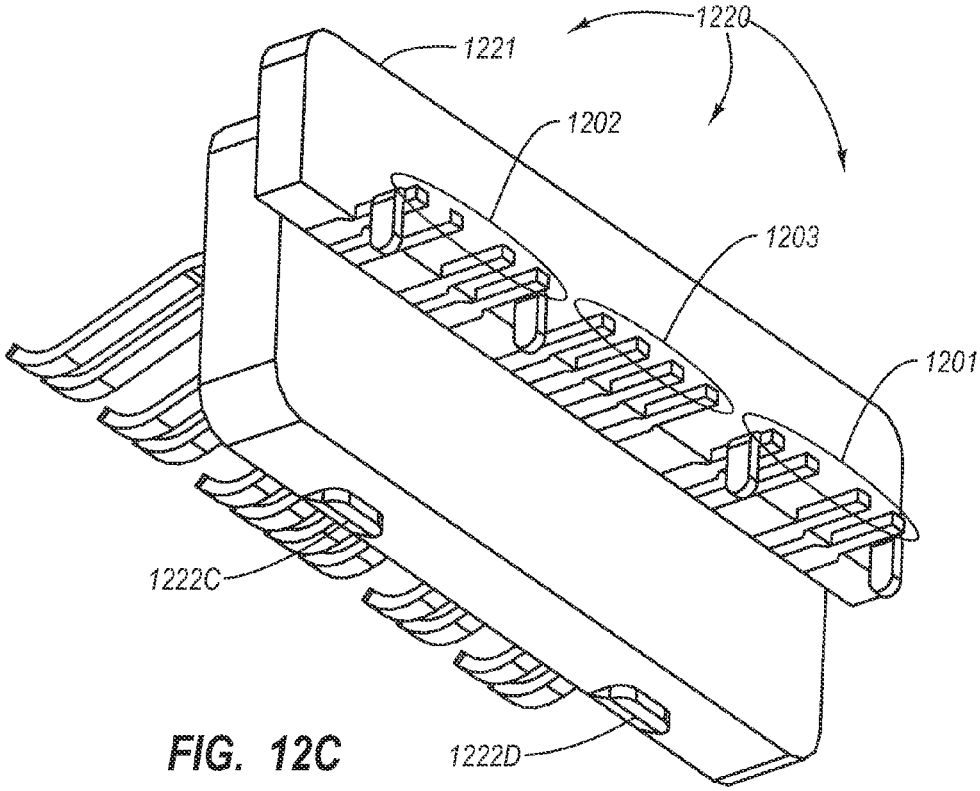
FIG. 12C illustrates the components of FIG. 12B from a bottom rear perspective.

FIG. 12B illustrates a top rear perspective view of components 1220 of the electrical interface assembly 1105. The components 1220 include the contact groups 1201, 1202 and 1203 over-molded by a body 1221. FIG. 12C illustrates the components 1220 from a bottom rear perspective. In order to control the impedance of the various contacts, the contacts may have various forms within the body 1221. The body 1221 may be an insulating material so as to prevent short circuiting of the various contacts. The body 1221 contains various sloped protrusions 1222A through 1222D to allow for insulating housing to be mechanically interlocked with the body 1221 as will be described with respect to FIGS. 12D through 12G.

Figure 12D:
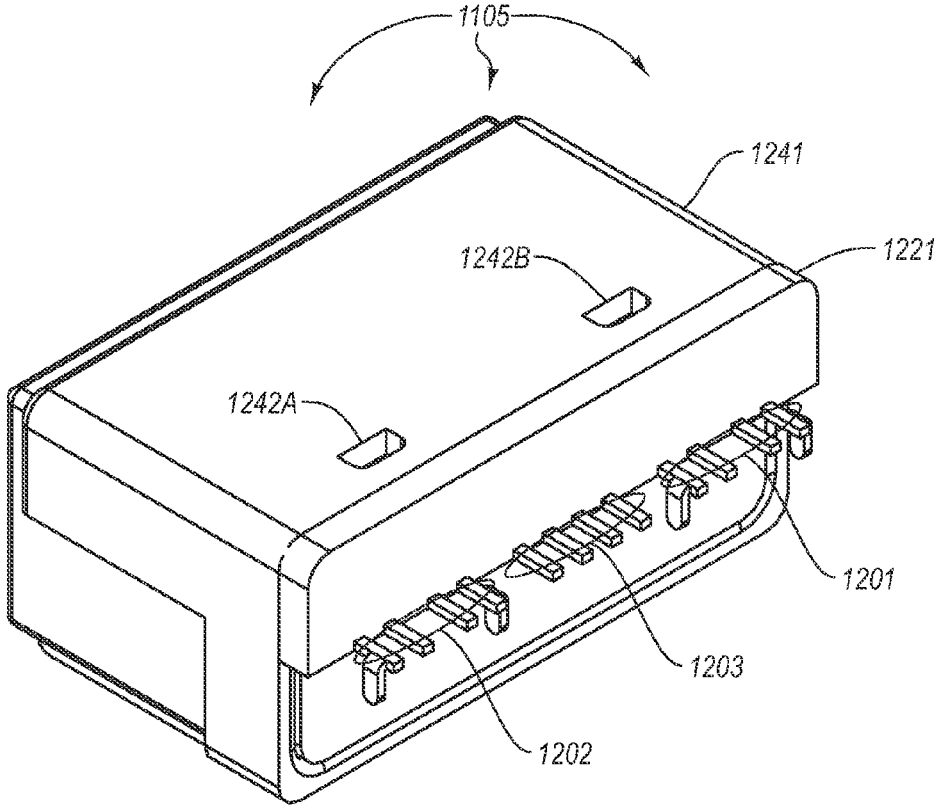
FIG. 12D illustrates a top rear perspective view of the electrical interface assembly, which adds a housing to the components of FIGS. 12B and 12C.
Figure 12E:
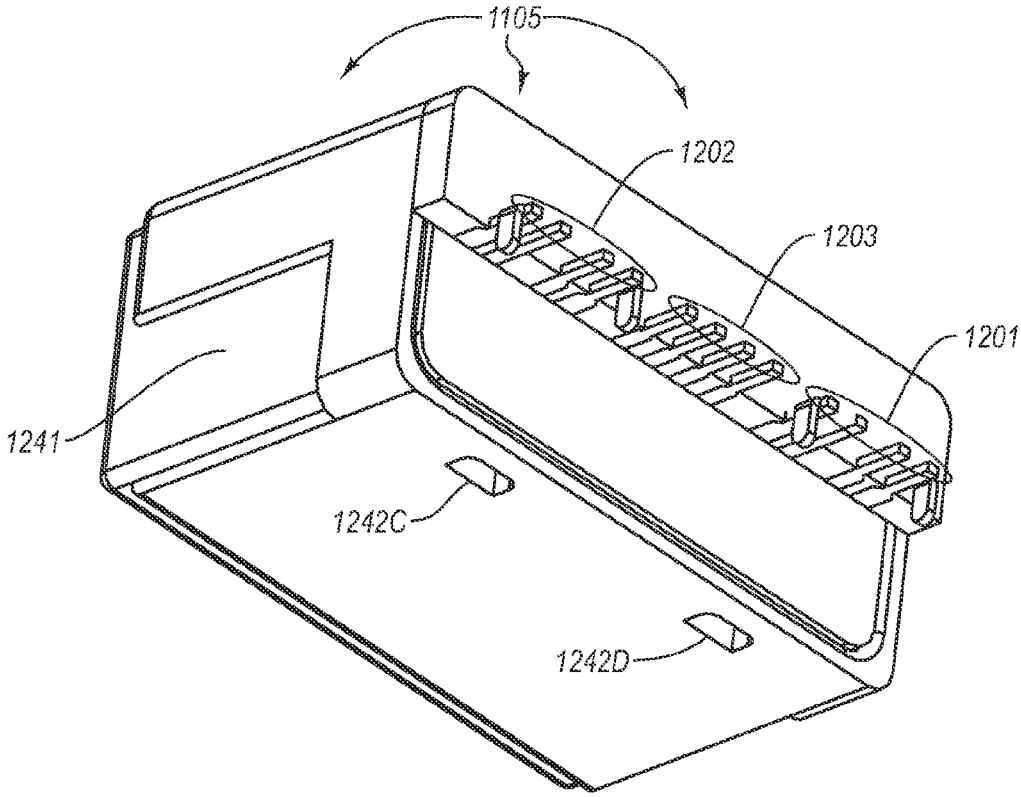
FIG. 12E illustrates a bottom perspective view of the electrical interface assembly of FIG. 12D.

Specifically, FIGS. 12D and 12E illustrate a respective top rear perspective view, and a bottom rear perspective view of the electrical interface assembly 1105, which adds a housing 1241 to the components 1220 of FIGS. 12B and 12C. The housing 1241 may be slid onto the components 1220 of FIGS. 12B and 12C from the front, such that the sloped protrusions 1222A through 1222D of the body 1221 engage with the holes 1242A through 1242D, respectively, of the housing 1241. The housing 1241 may be composed of a material that serves as an electrical insulator, such as plastic.

Figure 12F:
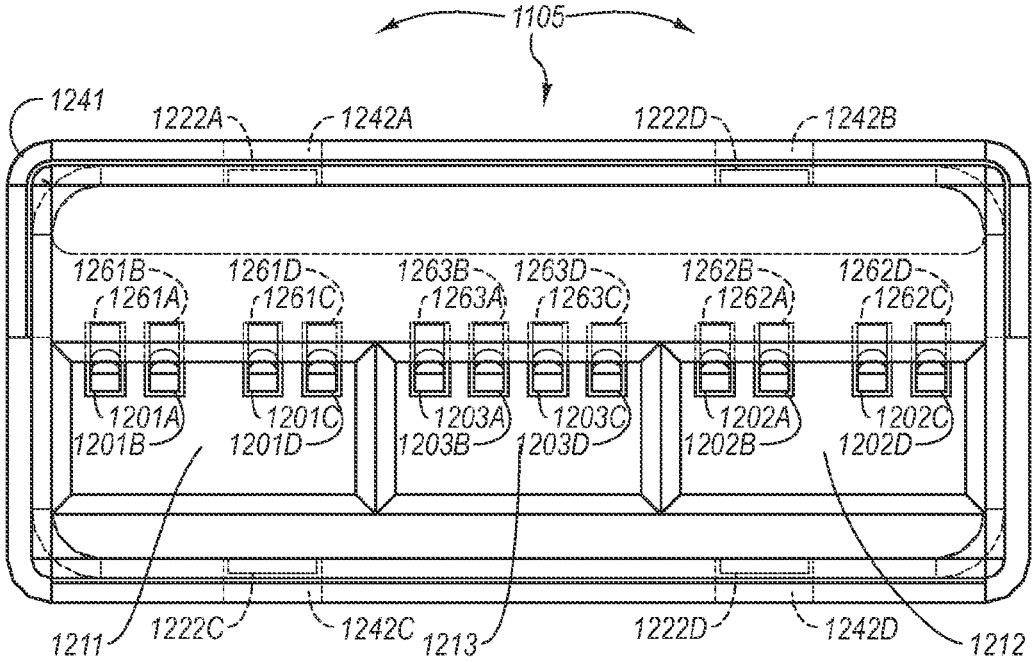
FIG. 12F illustrates a front view of the electrical interface assembly of FIGS. 12D and 12E, with portions being represented in transparent form to show the internal contact set.
Figure 12G:
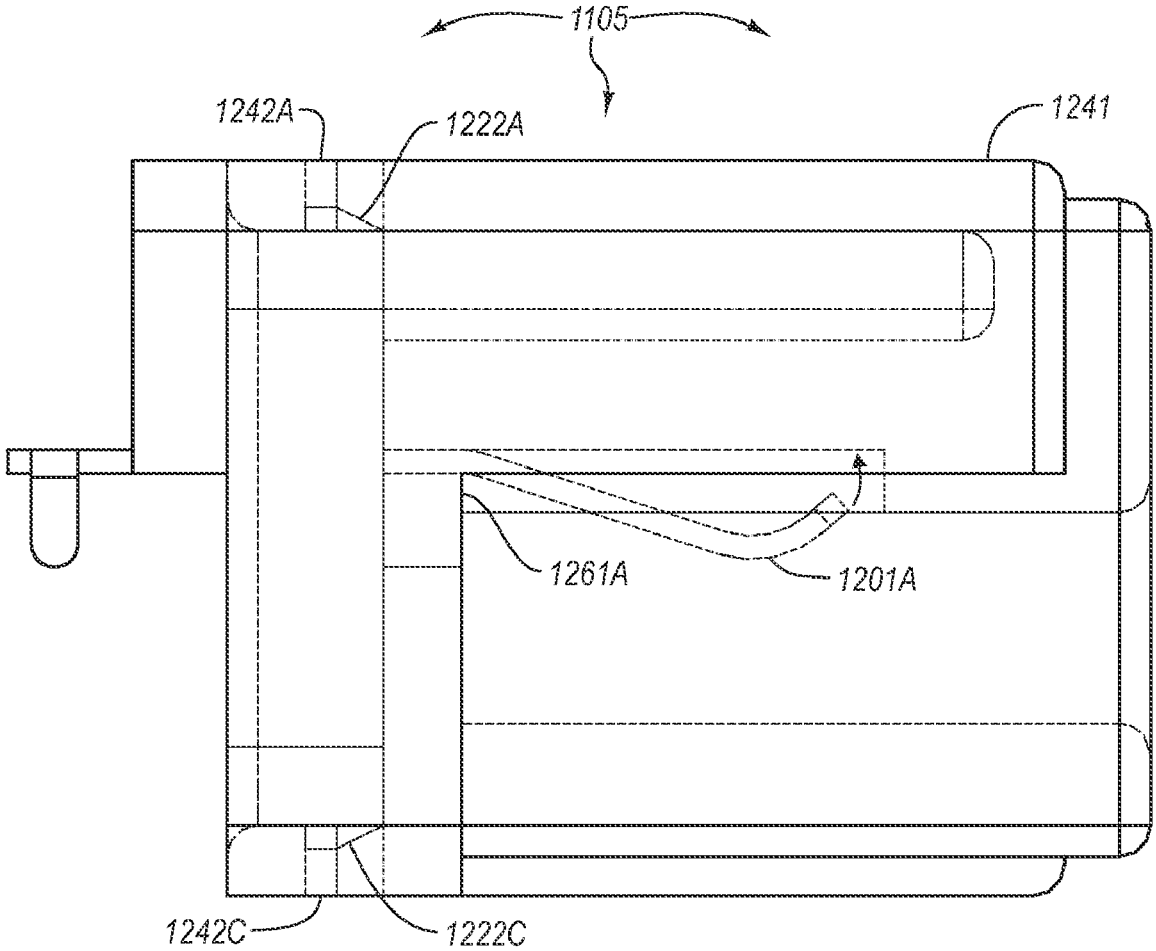
FIG. 12G illustrates a side view of the electrical interface assembly of FIGS. 12D through 12F, with portions being represented in transparent form to show the internal contact set.
Figure 13A:
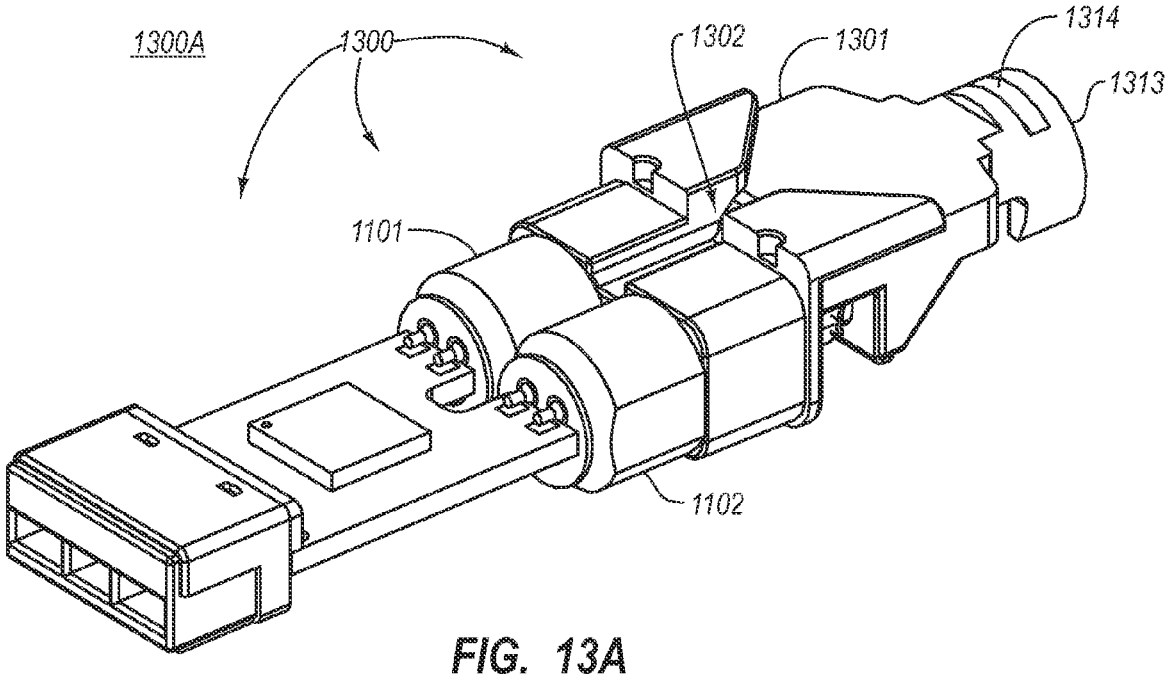
FIG. 13A illustrates a top front perspective view of components of the connector of FIGS. 11A through 11E, but with the narrow cylindrical insert portions of the TOSA and ROSA plugged into a plug chassis.
Figure 13B:
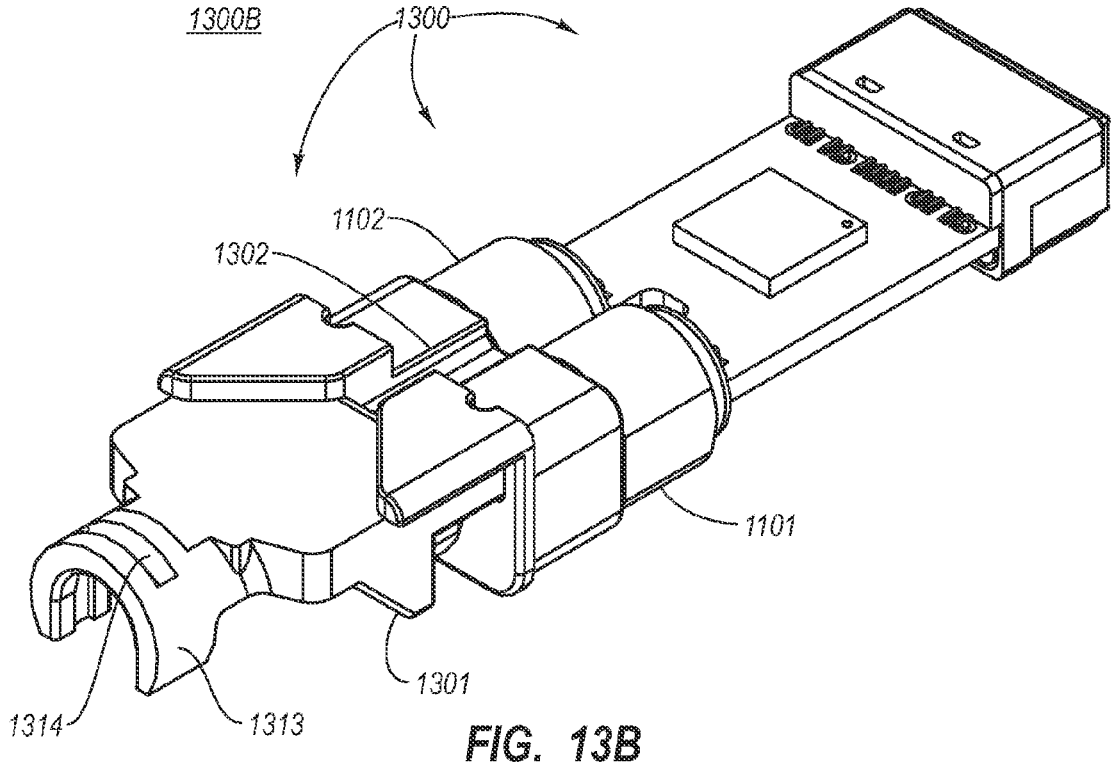
FIG. 13B illustrates a top rear perspective view of the components of FIG. 13A.
Figure 13C:
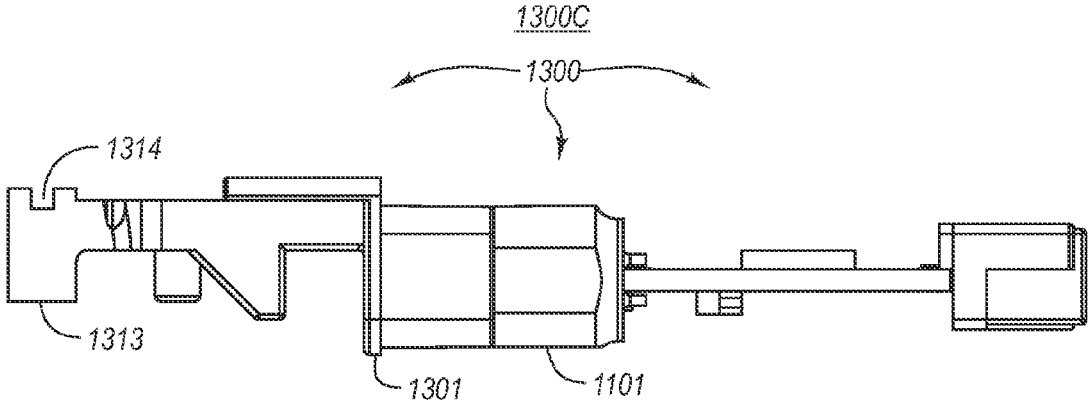
FIG. 13C illustrates a side view of components of FIGS. 13A and 13B.
Figure 13D:
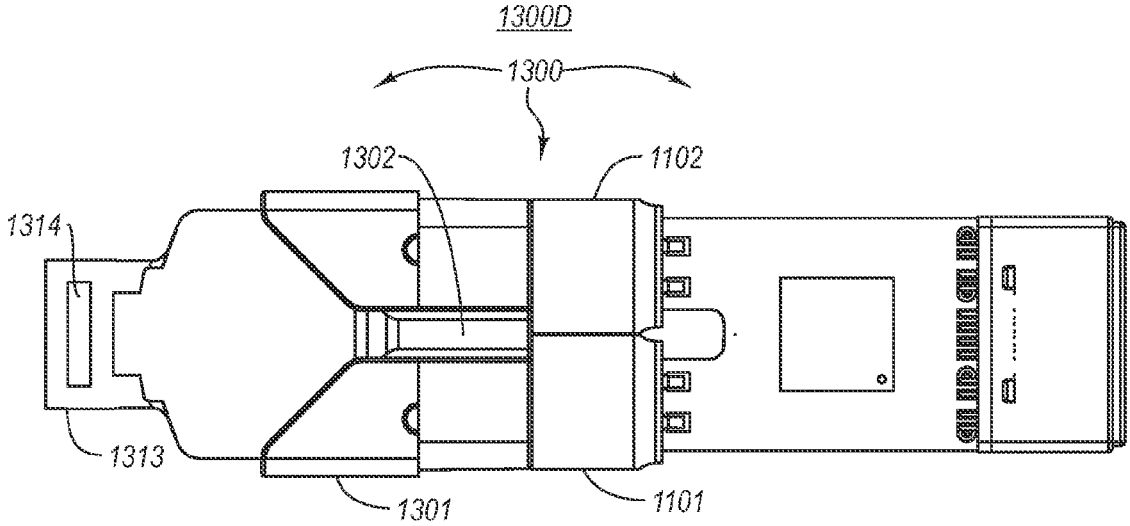
FIG. 13D illustrates a top perspective view of the components of FIGS. 13A through 13C.
Figure 13E:
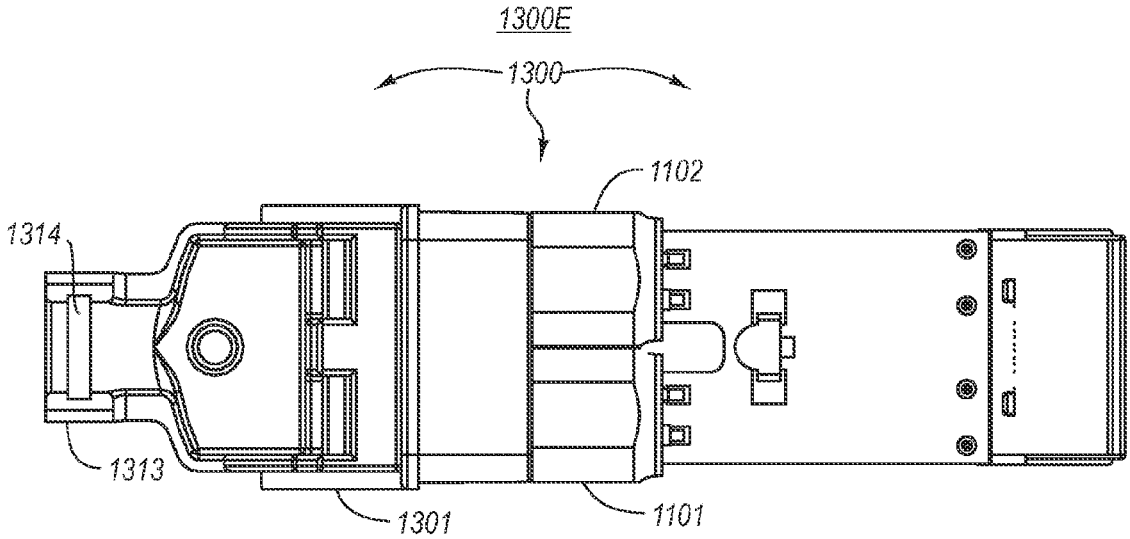
FIG. 13E illustrates a bottom view of components of FIGS. 13A through 13D.
Figure 13F:
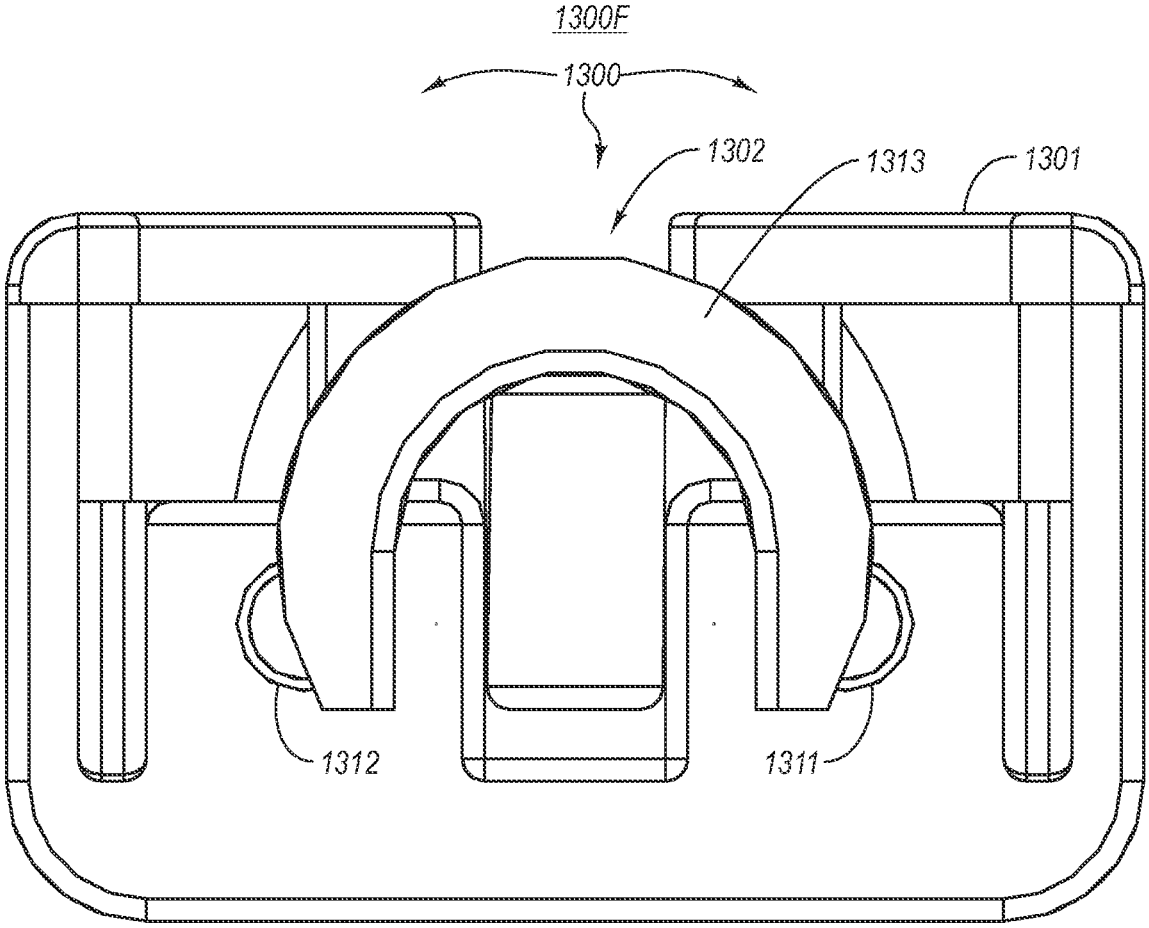
FIG. 13F illustrates a back view of components of FIGS. 13A through 13E.

FIGS. 12F and 12G illustrate a respective front view, and side view of the electrical interface assembly 1105. In this case however, the housing 1241 is shown in transparent form. As apparent from FIG. 12F, each of the electrical contacts 1201A through 1201D, 1202A through 1202D, and 1203A through 1203D extend through the body 1221, and through a respective hole 1261A through 1261D, 1262A through 1262D, and 1263A through 1263D, of the housing. As apparent from FIG. 12G, each of the contacts (e.g., electrical contact 1201A) has some clearance to move upwards when contacting an electrical connector of the receptacle, without making contact with the housing 1241.

As previously mentioned, the assembled electrical interface assembly 1105 may then be attached to the printed circuit board 1103 to formulate the components 1100 of FIGS. 11A through 11E.

FIGS. 13A through 13F illustrate a respective top front perspective view 1300A, top rear perspective view 1300B, side view 1300C, top view 1300D, bottom view 1300E, and back view 1300F, of components 1300 of the connector 1000. The components 1300 of FIGS. 13A through 13F add to the components 1100 of FIGS. 11A through 11E, by inserting the narrow cylindrical insert portion of the TOSA 1101 into a hole 1311 of a plug chassis 1301, and by inserting the narrow cylindrical insert portion of the ROSA 1102 into a hole 1312 of the plug chassis 1301. This mechanically couples the plug chassis 1301 to the TOSA 1101 and ROSA 1102. At this stage, the plug chassis 1301 might still be able to slide relative to the TOSA 1101 and ROSA 1102. However, in subsequent assembly steps, the plug chassis 1301 may be secured. The plug chassis 1301 has a channel region 1302 into which a light guide may be situated while lying flush with the upper surface of the plug chassis 1301. The plug chassis 1301 also has other features whose function will become apparent from subsequent description including a cable insertion portion 1313 having a slot 1314 formed therein. In one embodiment, the plug chassis 1301 serves as an EMI barrier at the back end of the connector. The plug chassis 1301 may be a die cast mold, and may perhaps be metal, or a plastic infused with the metal, such as, for example, zinc or copper.

Figure 14A:
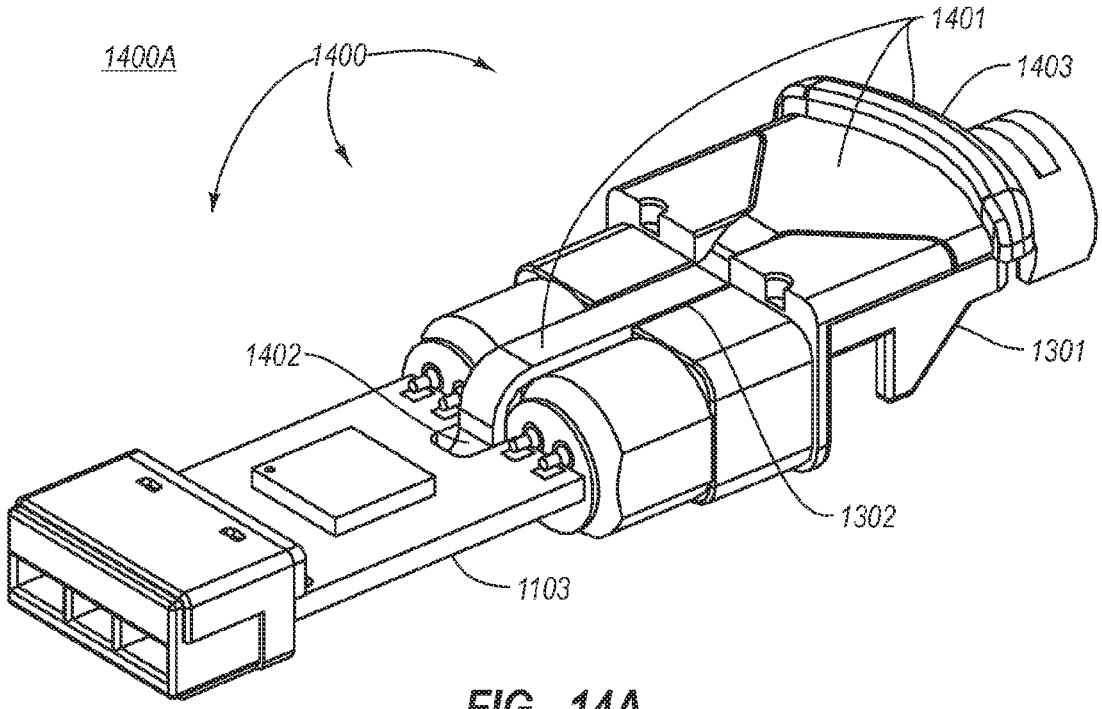
FIG. 14A illustrates a top front perspective view of components of the connector, which adds an optical light guide to the components of FIGS. 13A through 13G.
Figure 14B:
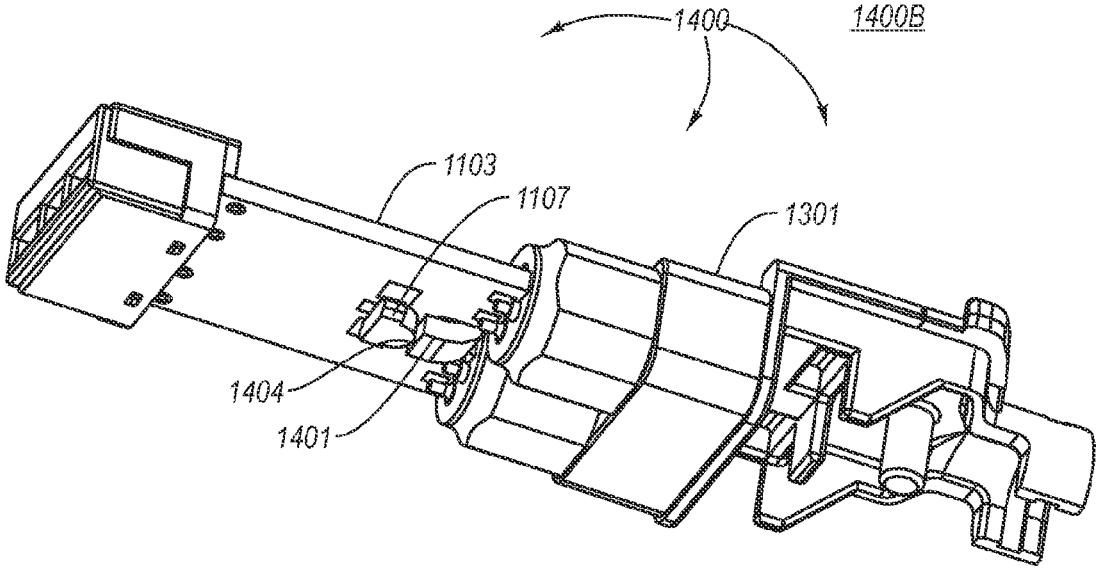
FIG. 14B illustrates a bottom front perspective view of the components of FIG. 14A.

FIGS. 14A and 14B illustrate a respective top front perspective view 1400A and bottom front perspective view 1400B of components 1400 of the connector 1000. The components 1400 of FIGS. 14A and 14B add to the components 1300 of FIGS. 13A through 13F by adding an optical light guide 1401. A portion 1404 of the optical light guide 1401 is passed through a hole 1402 in the printed circuit board 1103 to optically couple with the LED 1107. The optical light guide 1401 is situated in place by being placed into the channel 1302 of the plug chassis 1301. If light is emitted by the LED 1107, at least some of that light passes through the optical light guide 1401, and is emitted outside of the connector using external portion 1403 of the optical light guide 1401.

Figure 15A:
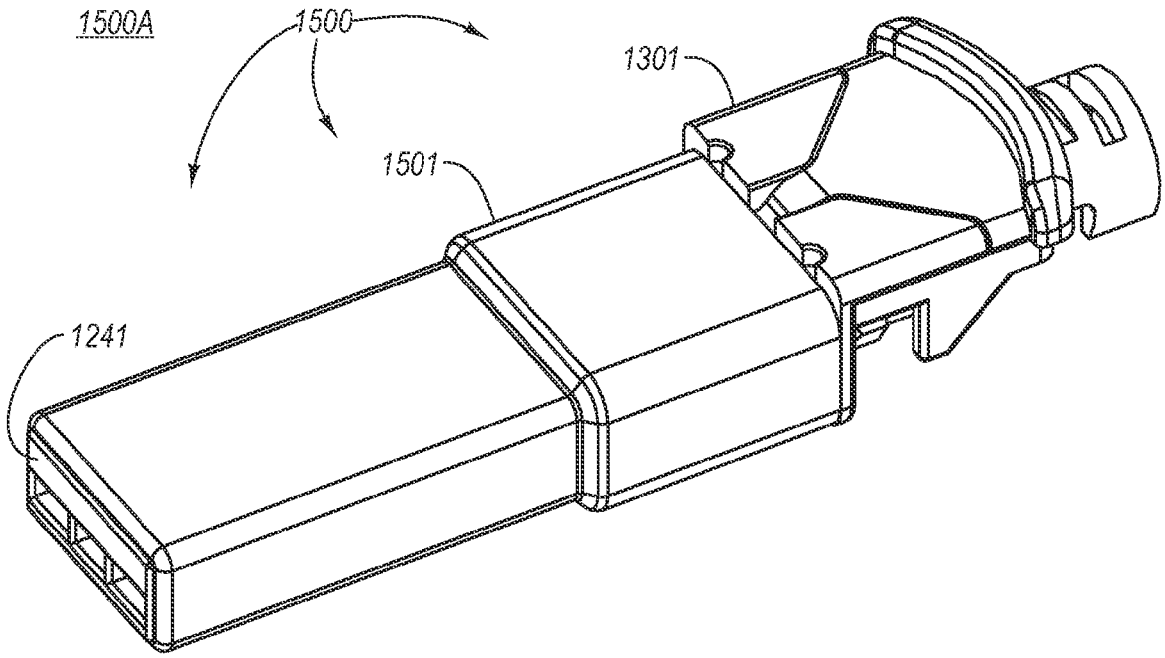
FIG. 15A illustrates a top front perspective view of components of the connector, which adds an integrated sleeve.
Figure 15B:
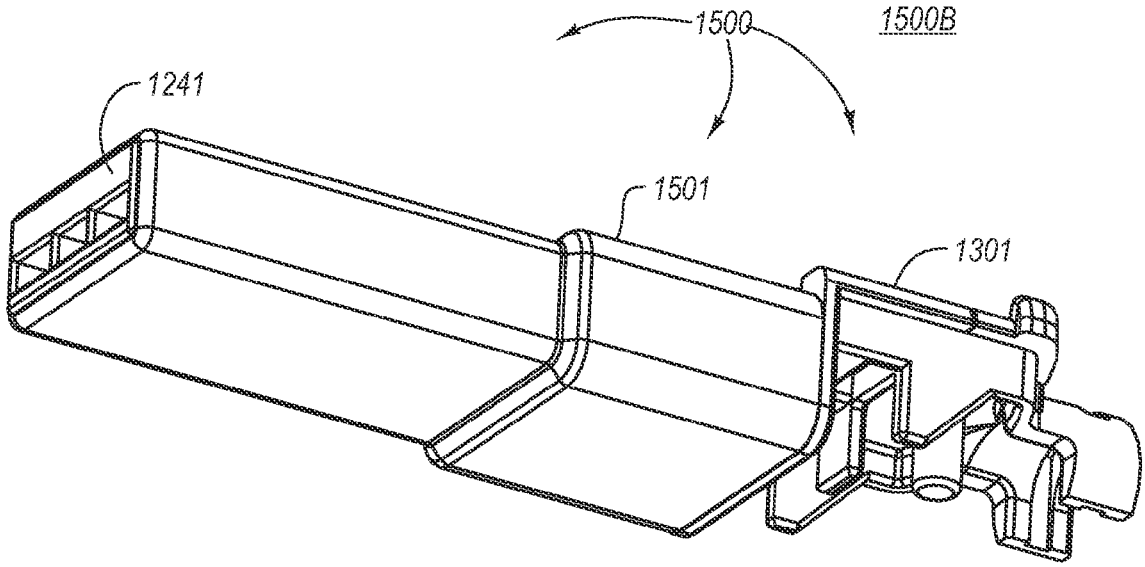
FIG. 15B illustrates a bottom front perspective view of the components of FIG. 15A.

FIGS. 15A and 15B illustrate a respective top front perspective view 1500A and bottom front perspective view 1500B of components 1500 of the connector 1000. The components 1500 of FIGS. 15A and 15B add to the components 1400 of FIGS. 14A and 14B by sliding an integrated sleeve 1501 over the front of the connector to thereby press fit with the plug chassis 1301. This mechanically fixes the parts of the connector in place. The integrated sleeve 1501 also serves as an EMI barrier. In one embodiment, the sleeve is composed of metal, but any other EMI barrier material will suffice. Accordingly, the sleeve, in combination with the plug chassis 1301 serve as an EMI barrier for the connector, except at the front end of the connector. As will be described hereinafter, even more complete EMI protection is afforded when the connector is plugged into a receptacle. As will be described hereinafter, when the connector is plugged in, a receptacle-side socket shield positioned at the back of the receptacle provides EMI protection to the front of the connector. Thus, in this plugged-in state, the connector is encased by an EMI shield, except for a few holes therein.

Specifically, the only holes in the EMI barrier are 1) the front of the connector, 2) the small apertures of the TOSA 1101 and ROSA 1102 through which the optical fibers and ferrules will pass, and 3) the small hole through which the optical light guide 1401 passes to communicate light from inside the EMI barrier to outside the EMI barrier. As mentioned above, the EMI barrier is completed by the socket shield in the receptacle when the plug is inserted. All of these holes are quite small, and thus there will be little in the way of EMI signals permitted to passes to or from the connector. This EMI barrier thus improves the signal quality of the high speed electrical signals, and other signals present within the connector. This also inhibits the high frequency signals generated within the connector from disturbing other equipment external to the connector.

Figure 16A:
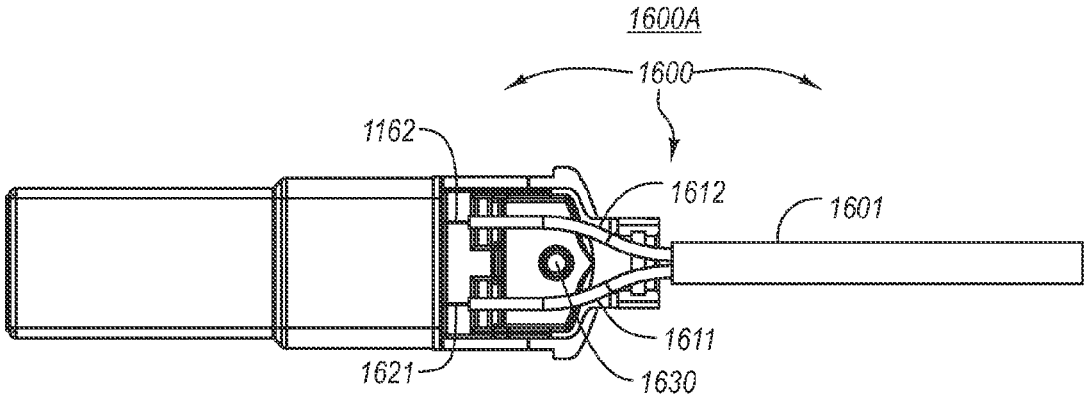
FIG. 16A illustrates a bottom view of components of the connector, which adds an optical cable to the components of FIGS. 15A and 15B.
Figure 16B:
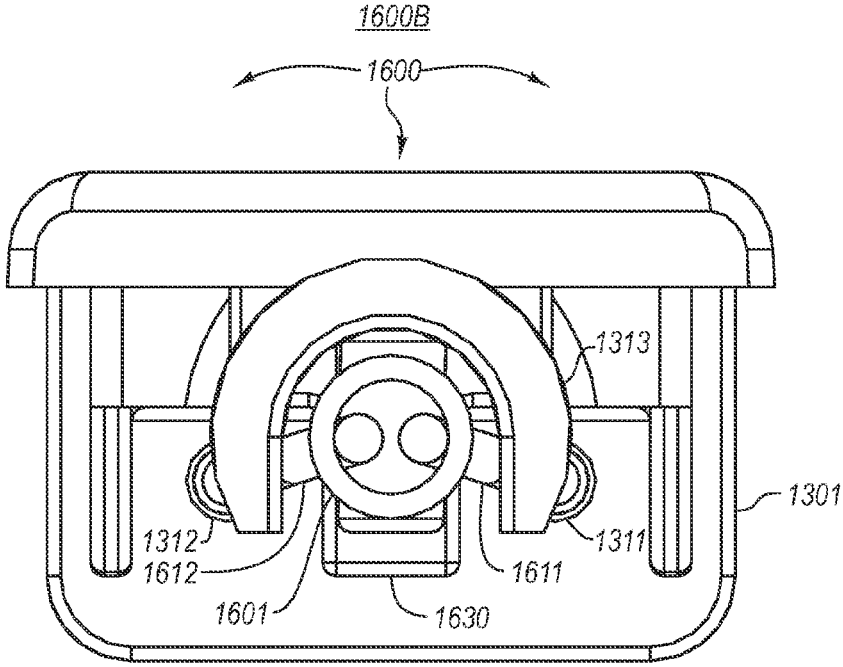
FIG. 16B illustrates a back view of components of FIG. 16A.
Figure 16C:
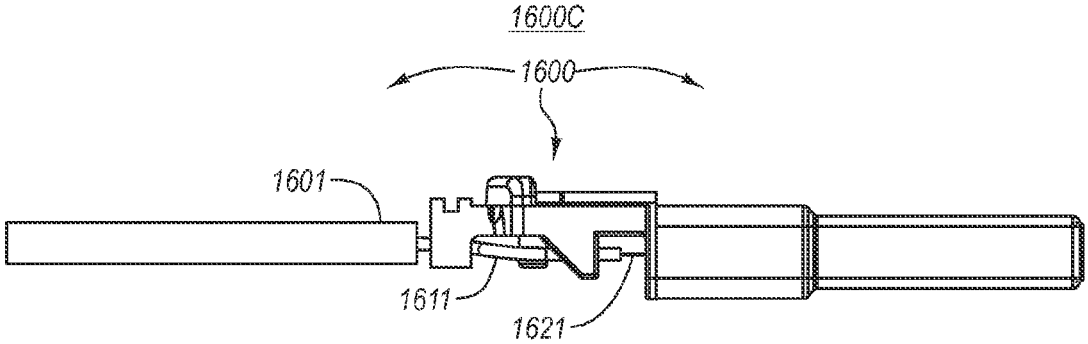
FIG. 16C illustrates a side view of components of FIGS. 16A and 16B.

FIGS. 16A through 16C illustrate a respective bottom view 1600A, back view 1600B, and side view 1600C of components 1600 of the connector 1000. The components 1600 of FIGS. 16A through 16C add to the components 1500 of FIGS. 15A and 15B in that an optical cable 1601 is added. The optical cable 1601 includes a transmit optical fiber 1611 that passes through the cable insertion portion 1313 of the plug chassis 1301. Its corresponding fiber core 1621 is optically coupled to the TOSA 1101 in a manner that will be explained with respect to FIGS. 17 through 19D. The optical cable 1601 also includes a receive optical fiber 1612 that passes through the cable insertion portion 1313 of the plug chassis 1301. Its corresponding fiber core 1622 is optically coupled to the ROSA 1102 in a manner that will be explained with respect to FIGS. 17 though 19D. A post 1630 is provided to allow a tensile member within the cable 1601 to be wrapped and secured to the post 1630, thereby inhibiting the cable 1601 from being removed from the connector. However, various crimping mechanisms may suffice for this purpose.

Figure 17:
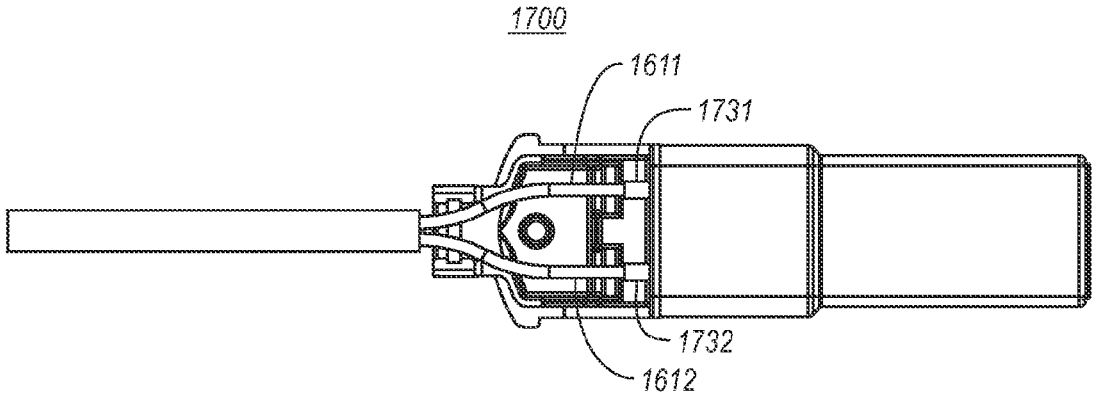
FIG. 17 illustrates a bottom view of components of the connector, which adds to components of FIGS. 16A through 16C in that the ferrules are shown assisting the coupling of the fibers to the respective TOSA and ROSA.

For a standard LC-type termination, an LC ferrule may be used to optically couple each of the fibers with their respective TOSA and ROSA. For example, FIG. 17 illustrates a bottom view of components 1700 of the connector, which adds to the components 1600 of FIGS. 16A through 16C in that the ferrules 1731 and 1732 are shown assisting the coupling of the fibers to the respective TOSA and ROSA.

Figure 18A:
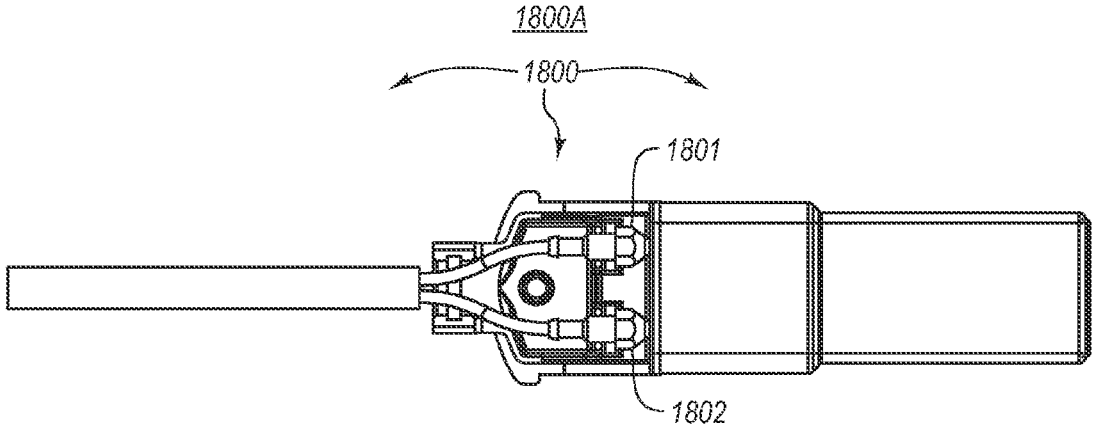
FIG. 18A illustrates a bottom view of components of the connector, which adds ferrule holders to the components of FIG. 17.
Figure 18B:
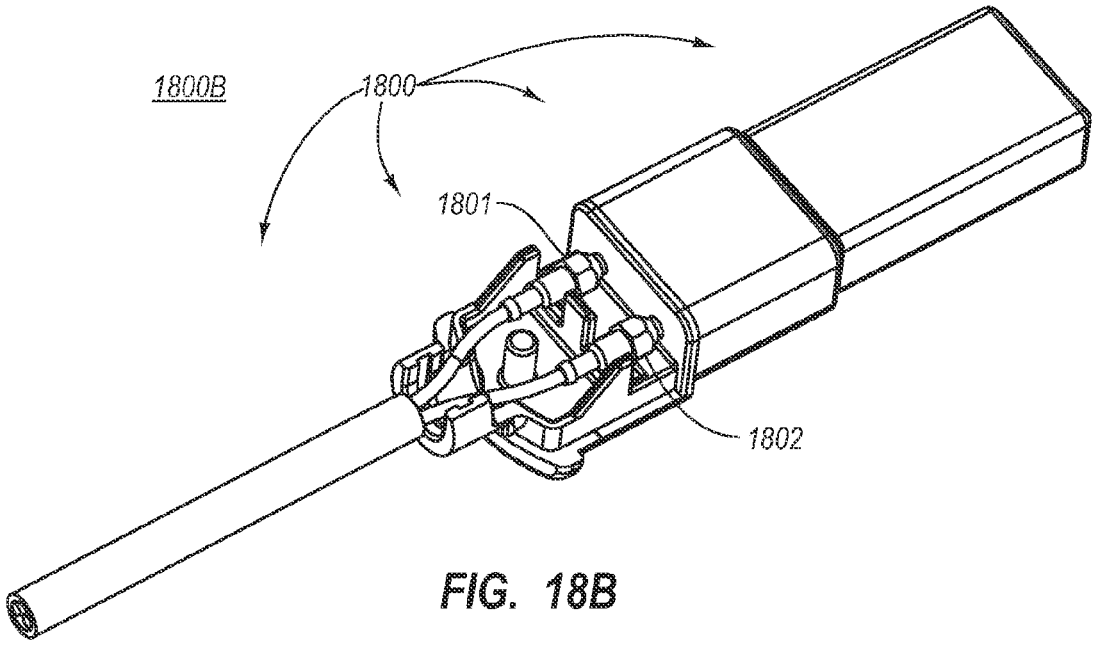
FIG. 18B illustrates a bottom rear perspective view of components of FIG. 18A.

FIGS. 18A and 18B illustrate a respective bottom view 1800A, and a bottom rear perspective view 1800B of components 1800 of the connector. The components 1800 of FIGS. 18A and 18B add to the components 1700 of FIG. 17 in that a ferrule holders 1801 and 1802 are added for the purpose of assisting in holding the underlying ferrules 1731 and 1732, respectively in place within their respective TOSA and ROSA. In actual assembly, the state illustrated in FIGS. 16A through 16C might not actually exist. Rather each of the fiber cores may be terminated as appropriate one at a time. For instance, in order to terminate each fiber, the appropriate ferrule may be coupled to the end of the fiber, and the ferrule holder position on the fiber. The ferrule may then be inserted into the appropriate TOSA or ROSA.

FIGS. 19A through 19D illustrate a respective side view 1900A, bottom view 1900B, bottom rear perspective view 1900C, and back view 1900D of components 1900 of the connector. The components 1900 of FIGS. 19A through 19D add to the components 1800 of FIGS. 18A and 18B in that a ferrule spring clip 1901 is positioned in place to thereby apply a forward force to the ferrule holders 1801 and 1802. Thus, the ferrule holders 1801 and 1802 are able to hold the ferrules in place within the TOSA and ROSA, respectively. The ferrule holders (and thus the corresponding ferrules) are restrained from rotating due to their hexagonal shape, and due to the fact that one face of the hexagon is placed in close proximity to the plug chassis. The hexagonal shape also allows for a large bearing surface between the ferrule spring clip 1901 on the ferrule holders 1801 and 1802.

Figure 19A:
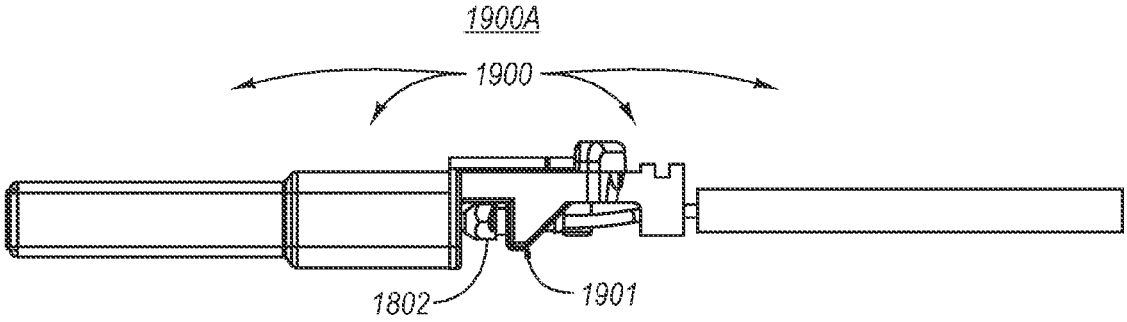
FIG. 19A illustrates a side perspective view of components of the connector, which adds a ferrule spring clip to the components of FIGS. 18A and 18B.
Figure 19B:
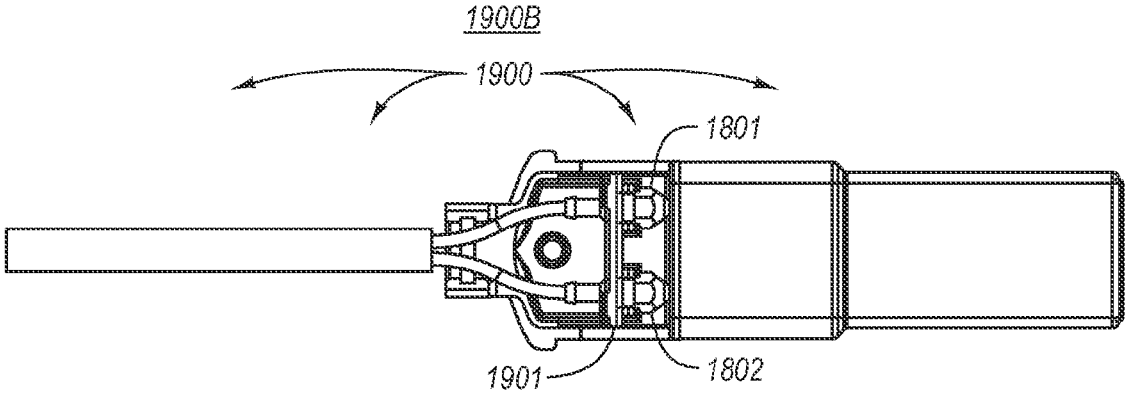
FIG. 19B illustrates a bottom perspective view of components of FIG. 19A.
Figure 19C:
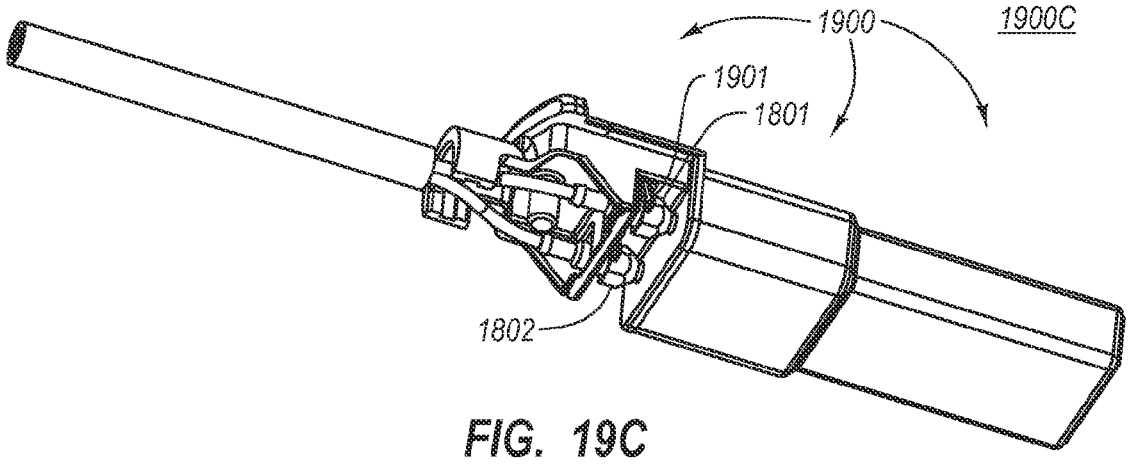
FIG. 19C illustrates a bottom rear perspective view of components of FIGS. 19A and 19B.
Figure 19D:
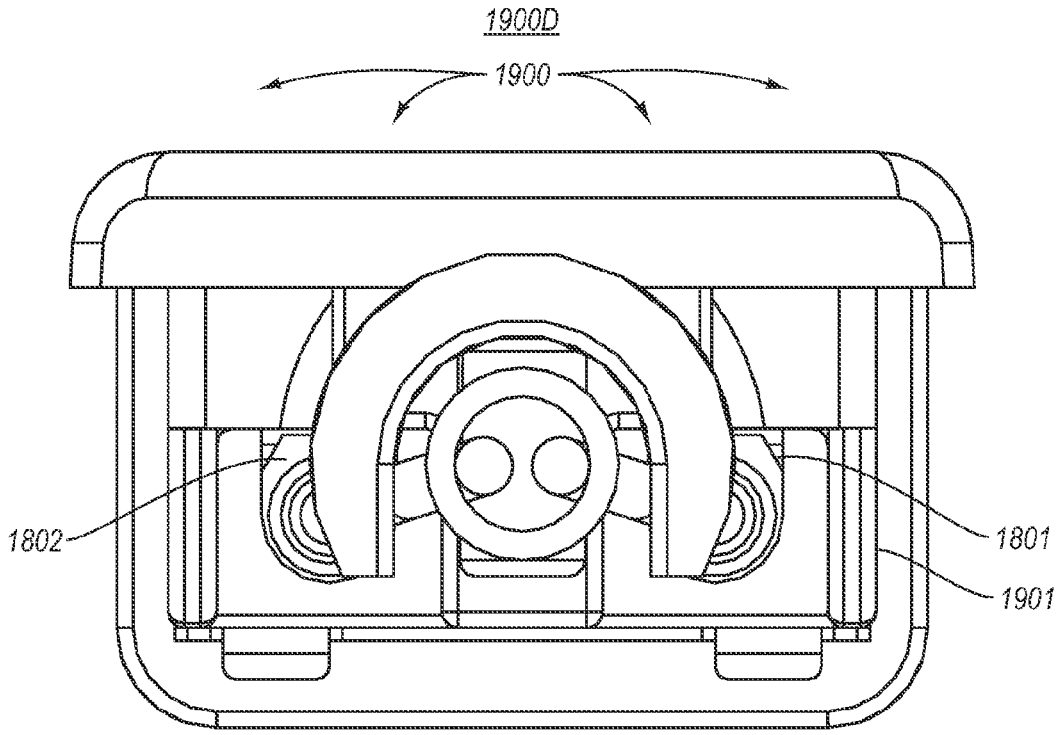
FIG. 19D illustrates a back view of components of FIGS. 19A through 19C.
Figure 20:
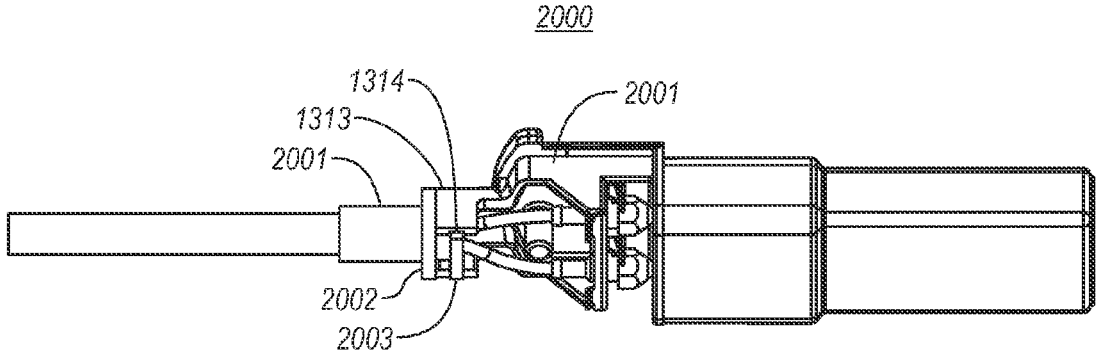
FIG. 20 illustrates a bottom view of components, which add to the components of Figures only in that the bushing is added to the components of FIGS. 19A through 19D.

FIG. 20 illustrates a bottom perspective view of components 2000, which add to the components 1900 of FIGS. 19A and 19D, only in that the bushing 2001 is configured in place. The bushing 2001 includes a portion 2003 that inserts into the slot 1314 of the plug chassis 1301. The bushing also includes a flange 2002 that abuts against the cable insertion portion 1313 of the plug chassis 1301 when the portion 2003 is inserted into the slot 1314.

Figure 21:
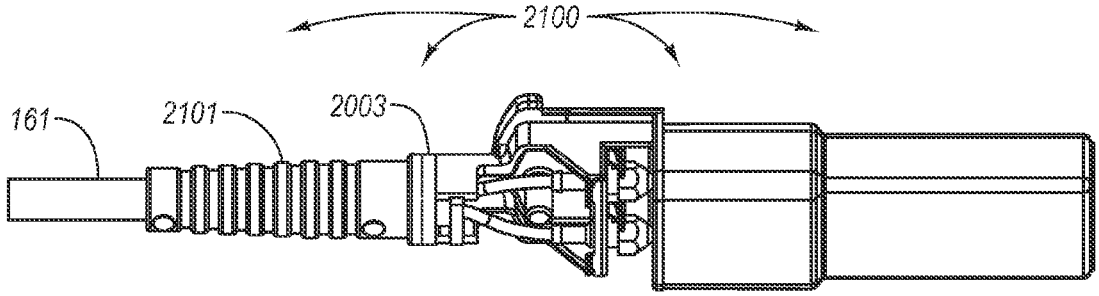
FIG. 21 illustrates a bottom perspective view of components, which add to the components of FIG. 20 in that a strain relief boot is pulled to about the flange to thereby compression fit around the bushing.
Figure 22A:
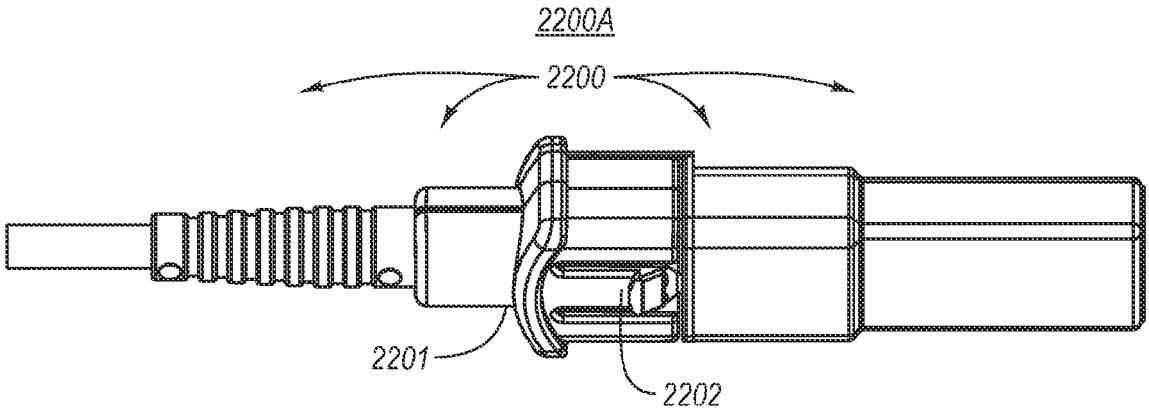
FIG. 22A illustrate a bottom perspective view of the components of the connector.
Figure 22B:
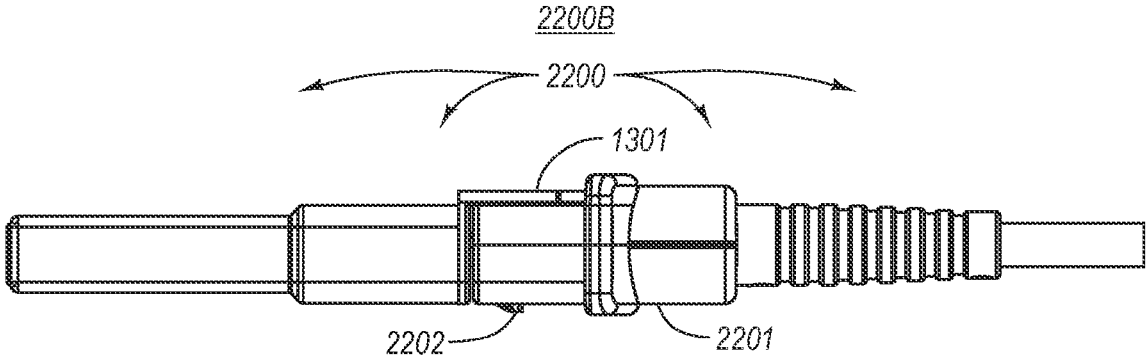
FIG. 22B illustrates a side view of the components of the connector.
Figure 22C:
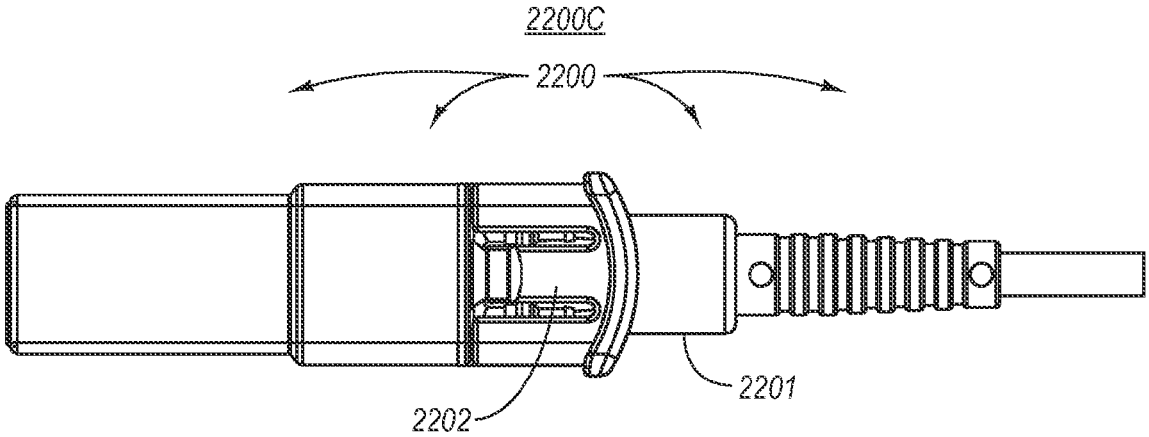
FIG. 22C illustrates a bottom view of the components of the connector.
Figure 22D:
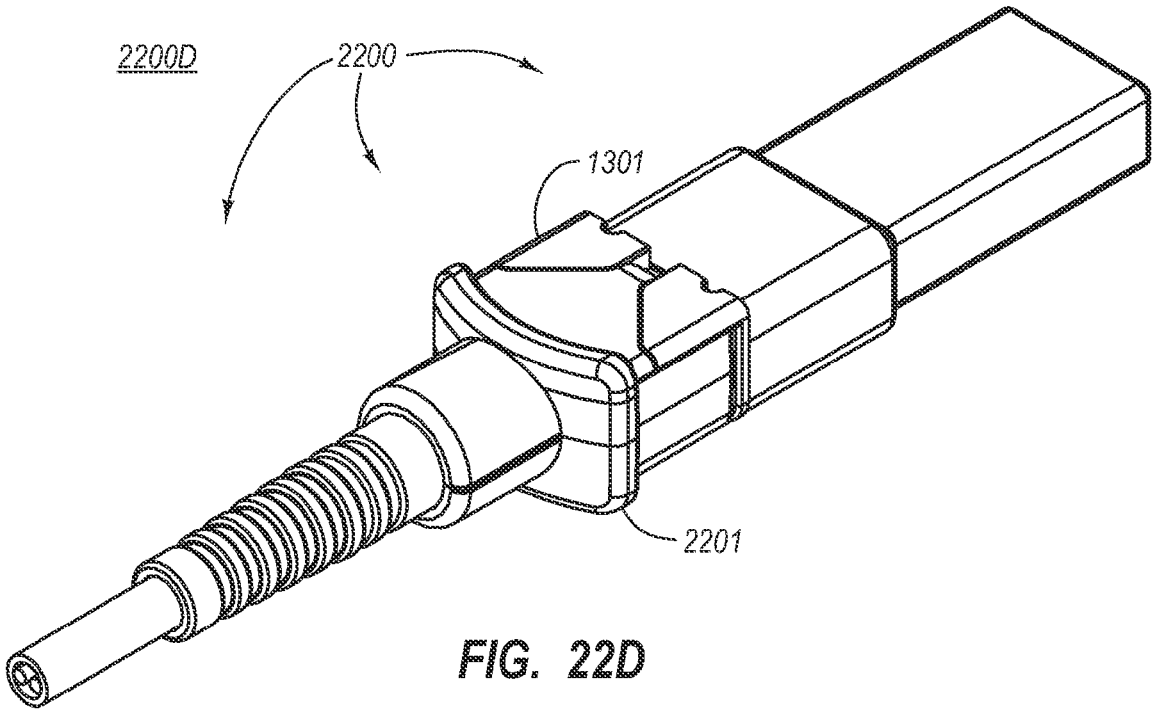
FIG. 22D illustrates a respective top rear perspective view of the components of the connector.

FIG. 21 illustrates a bottom perspective view of components 2100, which add to the components 2000 of FIG. 20, in that a strain relief boot 2101 is pulled to abut the flange 2003 to thereby compression fit around the bushing 2001 (underneath the boot 2101 in FIG. 21). Both the bushing 2001 and the boot 2101 may be placed on the cable 1601 prior to terminating the fibers in the TOSA and ROSA. That way, the bushing 2001 and cable 2101 need only be pulled forward guided by the cable 1601 to be placed in proper position as described.

FIGS. 22A through 22D illustrate a respective bottom perspective view 2200A, side view 2200B, bottom view 2200C, and top rear perspective view 2200C of the components 2200 of the connector. The components 2200 of FIGS. 22A through 22D add to the component 2100 of FIG. 21 in that backshell component 2201 is slid up from the cable and positioned in place to provide an appropriate covering for the plug chassis 1301. The backshell component 2201 includes a latch 2202 which has some clearance to press downward towards the plug chassis.

As apparent from FIGS. 10A through 10C, the final step in the connector 1000 assembly is to slide a latch piece 1002 over the front of the connector. The latch piece 1002 latches with the latch 2202 of the backshell component 2201 to thereby snap into place, thereby completing the connector. Some of the internals of the connector could be reworked by simply disengaging the latch 2202, removing the latch piece 1002, and sliding back the backshell 2201 component.

Accordingly, an embodiment of a connector has been described that permit for reduced EMI emissions for electromagnetic radiation originating from inside the connector.

The connector shown in FIGS. 10 through 22D includes a termination of an optical fiber using a ferrule such as, for example, an LC ferrule. Such termination might be performed, for example, using a glass fiber. However, the principles of the present invention also extend to connectors in which plastic fiber is terminated and used within the connector.

When the fiber is glass or plastic, termination may be accomplished using different methods. For example, the cable may simply be cut to the correct length, with the cable protective layers removed from the very end of the cable to expose the optical fibers. The fibers may then be cut cleanly perpendicular to the cable length. The fibers may then be inserted directly into the holes 1311 and 1312 of the plug chassis 1301. In that embodiment, the diameter of the holes 1311 and 1312 would be different from that shown in FIGS. 13A through 13F to account for the difference in diameter between the naked fiber, and a ferrule. Furthermore, instead of a ferrule holding clip 1901, some other mechanism may be used to provide a forward bias to the fiber to thereby mechanically fix the fiber into the appropriate aperture of the TOSA or ROSA. This termination may be accomplished in the field or at the time of cable manufacture.

In the described embodiments, the fiber termination may occur by accessing the outside of the EMI barrier (defined by the plug chassis 1301 on the back, the housing 1241 on the front, and the sleeve 1501 therebetween). However, the terminated fiber may then be inserted into the EMI barrier through a small hole. Accordingly, the design of the fiber termination mechanism may be done with relative independence to the design of the EMI barrier. Furthermore, as previously mentioned, the fiber termination mechanism may be quite easily accessed by first removing the latch mechanism 1002, and then removing the backshell mechanism 2201. That would expose the fiber, allowing for appropriate reworking of the fiber termination if desired, or perhaps for easy replacement of the connector itself.

Such a dual use receptacle has significant advantages. Many types of equipment which require networking or other electrical connections have the physical constraint of not having enough space for all the required or desired electrical receptacles. This is particularly the case when the often large number of desired legacy connections is considered. In many device such as, for example, a compact laptop computer, the number of electrical connectors can actually increased the overall size of the design. Similarly, this constraint might limit the different types of connections supported in a piece of compact equipment, and lead to undesired tradeoffs when trying to support a new connection type.

Another very important application is networking switch or routers. This dual use receptacle may maximize the number of connections in a given chassis size. For example, it is common for Ethernet networking equipment to support 48 RJ-45 ports in a standard 1U rack space for connections of up to 1 Gb/s per port. If a new type of connector is required, say for 10 Gb/s connections, then the manufacturer either must provide different chasses with 48 ports of each type, or some combination of 1 and 10 G ports with significantly less than 48 ports of one type or the other.

The dual use connector described herein addresses both of these concerns. It would allow, for example, the inclusion of 10 G ports in a system (e.g., a laptop, server or other device) which already has space provided for 1 G RJ-45 connections. Similarly, it would allow 48 ports of 1 G and 10 G connections in a 1U switch (of course with only 48 ports being usable at one time).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A receptacle for receiving a RJ-45 connector and a LASERWIRE connector comprising:

means for receiving the RJ-45 connector including a first contact set; and means for receiving the LASERWIRE connector including a second contact set, wherein the first contact set is positioned within the receptacle such that when the RJ-45 connector is inserted into the receptacle, the RJ-45 connector makes contact with the first contact set, but not the second receptacle contact set, and wherein the second contact set is positioned within the receptacle such that when the LASERWIRE connector is inserted into the receptacle, a contact set of the LASERWIRE connector makes contact with the second contact set, but not the first receptacle contact set.

2. The receptacle of claim 1, further comprising:

a connector detection mechanism configured to detect whether the LASERWIRE connector OR the RJ-45 connector is inserted into the receptacle.

3. The receptacle of claim 1, wherein the first contact set for connecting to the RJ-45 connector has external connections on a face of the receptacle which are substantially parallel to the direction of the connector plug insertion.

4. The receptacle of claims 3, wherein the second contact set has external connections on a face of the receptacle substantially perpendicular to the direction of the connector plug insertion.

5. The receptacle of claim 1, wherein the contact set of the RJ-45 connector has external connections that engage the first contact set disposed on a face of the receptacle body that exit the receptacle body substantially perpendicular to the direction of the connector plug insertion.

6. The receptacle of claims 5, wherein the LASERWIRE connector set has external connections that engage the second contact set disposed on a face of the receptacle body substantially perpendicular to the direction of the connector plug insertion.

7. The receptacle of claim 6, wherein the LASERWIRE connector allows for the transmission and reception of at least one pair of high speed (>1 Gb/s) serial links.

8. A receptacle of claim 7, wherein the second contact set provides power to the LASERWIRE connector.

9. A receptacle of claim 7, wherein the second contact set includes at least one pin provided to indicate the presence or absence of the LASERWIRE connector.

10. The receptacle of claim 1, wherein the RJ-45 connector type is in compliance with the TIA-968-A standard for RJ-45 connectors.

11. A communications system comprising:

first PHY circuitry means for providing an electrical connection with a first set of contacts in a receptacle, the first set of contacts for making electrical contact with a RJ-45 connector when the RJ-45 connector is plugged into the receptacle; and second PHY circuitry means for providing an electrical connection with a second set of contacts in the receptacle, the second set of contacts for making electrical contact with a LASERWIRE connector when the LASERWIRE connector is plugged into the receptacle.

12. A communication system of claim 11, further comprising:

a switch for selecting which of the first or second PHY circuitry means is to electrically communicate with the corresponding contact set in the receptacle.

13. A communication system of claim 12, wherein the switch is configured to identify whether the RJ-45 connector or the LASERWIRE connector is present within the receptacle.

14. A communications system of claim 11, wherein the first PHY circuitry means complies with one or more of the following standards: 10BASE-T, 100BASE-TX, 1000BASE-T.

15. A communications system of claim 14, wherein the second PHY circuitry means has a serial electrical interface with a pair of high speed electrical connections.

16. A communications system of claim 14, wherein the second PHY circuitry means complies with one or more of the following standards: 10GBASE-R, 10GBASE-W, or 1000-BASE-X.

17. A communications system of claim 14, wherein the second PHY circuitry means complies with the SFI standard.

18. A communications system of claim 14, wherein the second PHY circuitry means complies with the XFI standard.

* * * * *